US006012794A

United States Patent [19]

Nakano et al.

[11] Patent Number: 6,012,794

[45] Date of Patent: Jan. 11, 2000

[54] INKJET PRINTING APPARATUS WHICH DETERMINES RESIDUAL INK AMOUNT, AND METHOD OF DETECTING INK

[75] Inventors: Yuji Nakano, Kawasaki; Minoru Yokoyama, Yokohama; Naohiro Iwata, Yokosuka; Shunji Kawashima, Saitama-ken; Hideyuki Terashima, Sagamihara, all of Japan

[73] Assignee: Canon Kabushiki Kaisha, Tokyo, Japan

[21] Appl. No.: 08/819,814

[22] Filed: Mar. 18, 1997

[30] Foreign Application Priority Data

Mar. 22, 1996 [JP] Japan ..... 8-066301

[51] Int. Cl.[7] ..... B41J 2/195

[52] U.S. Cl. ..... 347/7; 73/293

[58] Field of Search ..... 347/7, 14, 19, 347/37; 73/293, 290 R

[56] References Cited

U.S. PATENT DOCUMENTS

| | | | |
|---|---|---|---|
| 4,313,124 | 1/1982 | Hara | 346/57 |
| 4,345,262 | 8/1982 | Shirato et al. | 346/10 |
| 4,459,600 | 7/1984 | Sato et al. | 346/47 |
| 4,463,359 | 7/1984 | Ayata et al. | 346/56 |
| 4,558,333 | 12/1985 | Sugitani et al. | 346/65 |
| 4,608,577 | 8/1986 | Hori | 346/66 |
| 4,723,129 | 2/1988 | Endo et al. | 346/56 |
| 4,740,796 | 4/1988 | Endo et al. | 346/56 |
| 4,768,377 | 9/1988 | Habelmann et al. | 73/313 |
| 5,250,957 | 10/1993 | Onozato | 347/7 |
| 5,406,315 | 4/1995 | Allen et al. | 347/7 |
| 5,596,351 | 1/1997 | Stapleton | 347/7 |
| 5,900,888 | 5/1999 | Kurosawa | 347/7 |

FOREIGN PATENT DOCUMENTS

| | | |
|---|---|---|
| 0573274 | 12/1993 | European Pat. Off. . |
| 0709208 | 5/1996 | European Pat. Off. . |
| 3408302 | 9/1985 | Germany . |
| 54-056847 | 5/1979 | Japan . |
| 56-144184 | 11/1981 | Japan . |
| 56-144185 | 11/1981 | Japan . |
| 59-123670 | 7/1984 | Japan . |
| 59-138461 | 8/1984 | Japan . |
| 60-071260 | 4/1985 | Japan . |
| 60-090767 | 5/1985 | Japan . |
| 60-115451 | 6/1985 | Japan . |
| 60-172546 | 9/1985 | Japan . |
| 60-253552 | 12/1985 | Japan . |
| 61-086265 | 5/1986 | Japan . |
| 62-021549 | 1/1987 | Japan . |
| 62-156965 | 7/1987 | Japan . |
| 63-295266 | 12/1988 | Japan . |
| 01092621 | 4/1989 | Japan . |
| 2-78557 | 3/1990 | Japan . |
| 02102061 | 4/1990 | Japan . |
| 5278228 | 10/1993 | Japan . |
| 07087287 | 3/1995 | Japan . |

*Primary Examiner*—John Barlow
*Assistant Examiner*—Craig A. Hallacher
*Attorney, Agent, or Firm*—Fitzpatrick, Cella, Harper & Scinto

[57] ABSTRACT

A printing apparatus which can detect remaining ink with high precision regardless of trembles of ink surface in an ink tank caused by various factors such as scanning speed of a carriage, scanning width, impact of the carriage at the time of reversing the carriage scanning direction and the like, and can perform printing by efficiently utilizing the remaining ink, and a facsimile apparatus using the above printing apparatus. According to the apparatus, when a CPU controls print operation, the CPU dynamically changes the threshold value as a determination reference, utilized to detect remaining ink on the basis of an output current of a reflection type photosensor, in accordance with the scanning speed of carriage movement, the scanning width, and the stop period for reversing the scanning direction.

19 Claims, 12 Drawing Sheets

PHASEa
PHASEb
PHASEc
PHASEd
PHASEe
PHASEf
PHASEg
PHASEh
PHASEa
Aout
t

Aout
P1
P2
t

Aout
A1
P1
P2
THRESHOLD VALUE
D1
D2
t

Aout
D1
D2
t

Aout
t

INKJET PRINTING APPARATUS WHICH DETERMINES RESIDUAL INK AMOUNT, AND METHOD OF DETECTING INK

BACKGROUND OF THE INVENTION

Present invention relates to a printing apparatus and a facsimile apparatus utilizing the printing apparatus, and more particularly, to a printing apparatus which performs printing in accordance with an ink-jet printing method and a facsimile apparatus using the printing apparatus.

Conventionally, printers that perform printing in accordance with an ink-jet printing method employ various techniques as described below to detect the amount of residual ink in the ink tank.

Japanese Patent Application Laid-Open No. 2-102061 discloses a reflective type photosensor, with a reflection board provided in an ink tank, to detect shortage of ink. In Japanese Patent Application Laid-Open No. 56-144184, to avoid degradation of detection precision due to trembles of the ink surface, ink shortage status is notified after a predetermined period from detection of the status.

However, in the above conventional example, for instance, when a carriage loading an ink cartridge which integrally incorporates an ink tank and a printhead is moved, the ink surface trembles in various manner depending on differences in conditions e.g. scanning speed, scanning width, a scanning-stop period for reversing the scanning direction and the like. A problem arises in that such variance in ink surface largely affects the precision of detecting residual ink.

SUMMARY OF THE INVENTION

Accordingly, it is an object of the present invention to provide a printing apparatus capable of residual-ink detection with high precision regardless of trembles of ink surface generated by various factors such as scanning speed of a carriage, scanning width, impact of the carriage at the time of reversing the scanning direction and the like, and a facsimile apparatus using the printing apparatus.

According to one aspect of the present invention, the foregoing object is attained by providing a printer for performing print on a print medium by scanning a printhead and discharging ink from the printhead comprising: scan means for reciprocally moving the printhead; an ink tank, containing the ink and reciprocally moved together with the printhead by the scan means; detection means for detecting an amount of residual ink in the ink tank; monitor means for monitoring conditions of reciprocal movement of the printhead by the scan means; and control means for controlling the detection means such that a determination reference used by the detection means for detecting the amount of residual ink is changed in accordance with a monitoring result of the monitor means.

In accordance with the above aspect of the present invention as described above, upon printing by discharging ink on a print medium while scanning the printhead, the amount of ink within an ink tank, that contains the ink and that reciprocally moves along with the printhead, is detected. Conditions of the reciprocal movement of the printhead is monitored, and controlling is performed such that a determination reference used for the residual-ink detection is changed in accordance with the monitoring result.

The conditions of the reciprocal movement of the printhead include moving speed of the printhead, moving width of the printhead, a stop period for reversing the moving direction of the printhead and the like.

For the residual-ink detection, a photosensor having a light-emitting device with a photoreceptor, and a reflection board that reflects light from the light-emitting device are employed. The photosensor and the reflection board are set such that the light-emission direction of the light-emitting device and the reflection direction of the reflected light by the reflection board are parallel to the scanning direction of the printhead and the ink tank, and that the reflection surface of the reflection board is opposite to the light-emitting device. Further, the photosensor is in contact with an exterior side wall of the ink tank, while the reflection board is provided in the ink tank. Moreover, in residual-ink detection, output from the photosensor is compared with the determination reference. The detection is performed at a fixed timing of the reciprocal movement of the printhead.

The determination reference is changed when determination of ink shortage is made for the second time during further print operation which is continued after the amount of ink in the ink tank is reduced and determination of ink shortage is once made.

Note that the present invention employs a printhead which discharges ink by utilizing thermal energy, thus it is preferable to construct the printhead with a thermal energy transducer for generating thermal energy to be provided to ink.

Further, it is preferable to include display means for displaying a result of the residual-ink detection.

According to another aspect of the present invention, the foregoing object is attained by providing a printer for performing print on a print medium by scanning a printhead and discharging ink from the printhead comprising: scan means for reciprocally moving the printhead; an ink tank, containing the ink and reciprocally moved together with the printhead by the scan means; detection means for detecting an amount of residual ink in the ink tank; monitor means for monitoring conditions of reciprocal movement of the printhead by the scan means; and print control means for controlling such that the print operation is further continued even after the detection means detects shortage of the residual ink, wherein the print control means controls a duration period of the print operation further performed after the detection means detects shortage of the residual ink, in accordance with a monitoring result of the monitor means.

In accordance with the above aspect of the present invention as described above, when printing is performed by discharging ink on a print medium while scanning the printhead, the amount of ink in an ink tank, that contains the ink and that reciprocally moves together with the printhead, is detected. When printing operation is further performed even after determination of ink shortage is made, conditions of the reciprocal movement of the printhead is still monitored, and in accordance with the monitoring result, a duration period of the further print operation is controlled.

The conditions of the reciprocal movement of the printhead include moving speed of the printhead, moving width of the printhead, a stop period for reversing the moving direction of the printhead and the like.

For the residual-ink detection, a photosensor having a light-emitting device with a photoreceptor, and a reflection board that reflects light from the light-emitting device are employed. The photosensor and the reflection board are set such that the light-emission direction of the light-emitting device and the reflection direction of the reflected light by the reflection board are parallel to the scanning direction of the printhead and the ink tank, and that the reflection surface of the reflection board is opposite to the light-emitting device. Further, the photosensor is in contact with an exterior side wall of the ink tank, while the reflection board is provided in the ink tank. The detection of residual ink is performed at a fixed timing of the reciprocal movement of the printhead.

Furthermore, an amount of ink which is discharged in the print operation further performed after ink shortage is detected, is counted, and the counted amount of discharged ink is compared with a predetermined threshold value. The threshold value is changed in accordance with the aforementioned monitoring result.

Note that the present invention employs a printhead which discharges ink by utilizing thermal energy, thus it is preferable to construct the printhead with a thermal energy transducer for generating thermal energy to be provided to ink.

It should be noted that a printer according to the present invention employs any one of the above-mentioned printers.

The invention is particularly advantageous since it is possible to perform accurate detection of an amount of residual ink, without being influenced by the reciprocal movement of the printhead which affects the ink surface e.g. trembling the ink surface.

Also, it is advantageous since print operation can be performed by efficiently utilizing a small amount of ink remaining in the ink tank.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will be described in detail in accordance with the accompanying drawings.

<Structure of Apparatus (FIGS. 1 to 5)>

Mechanical Structure

Figure 1:
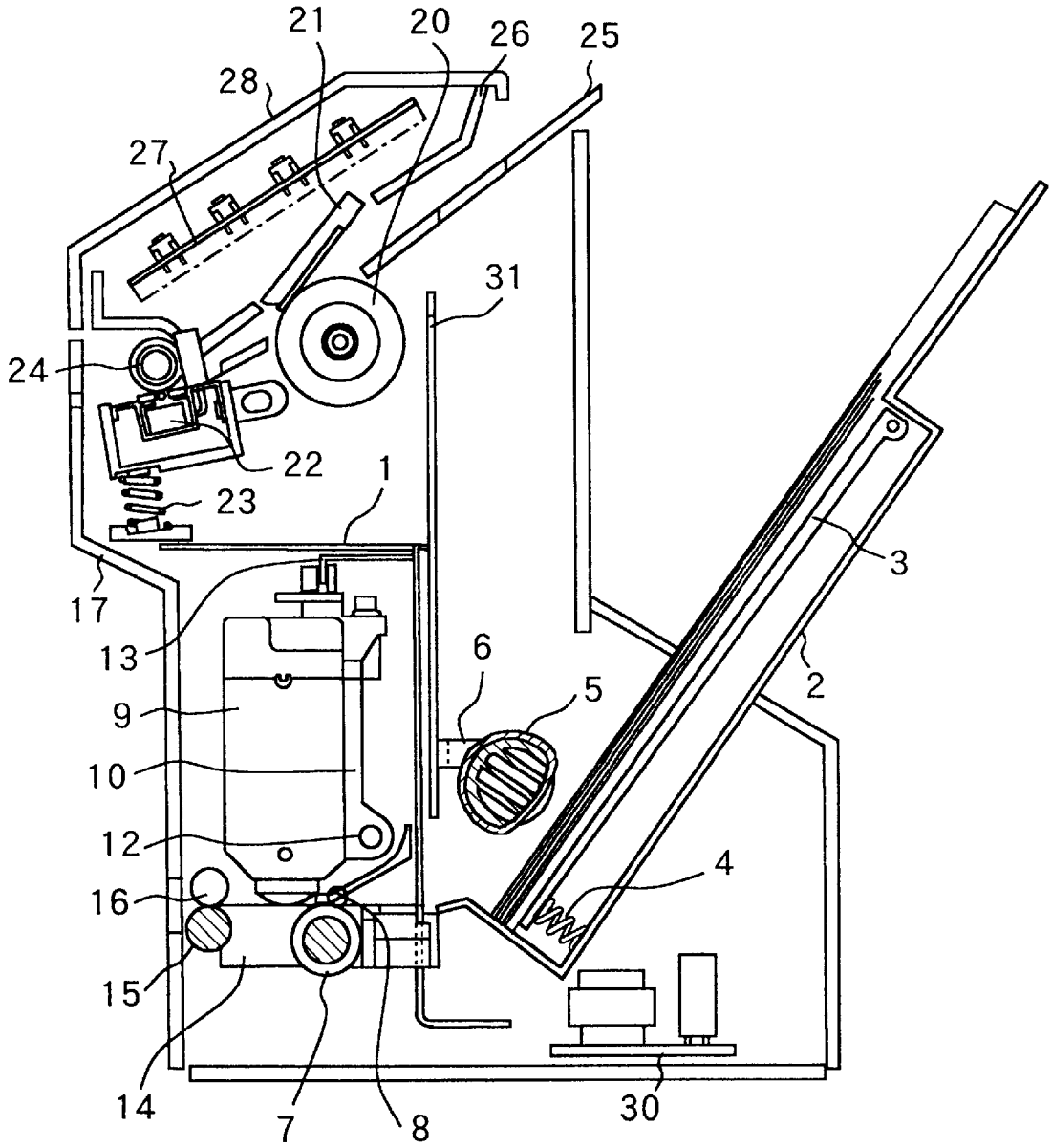
FIG. 1 is a cross-sectional view showing the mechanical construction of a facsimile apparatus having a printing unit which adopts an ink-jet printing method, as a typical embodiment of the present invention.

FIG. 1 is a cross-sectional view showing the mechanical structure of a facsimile apparatus having a printing unit in accordance with an ink-jet printing method, as a typical embodiment of the present invention.

First, the construction of the printing unit of the facsimile apparatus will be described.

In FIG. 1, reference numeral 1 denotes a frame (main frame) as a main constituent of the overall apparatus; 2, an ASF (Auto Sheet Feeder) chassis attached to the frame 1, as a cassette of the ASF for holding plural print sheets and feeding the sheets into the printing unit one by one; 3, an intermediate board rotatably attached to the ASF chassis 2; and 4, a spring for biasing the intermediate board 3 upward in a clockwise direction; 5, a print-sheet separation roller which rotates in the clockwise direction by a mechanically driven unit (not shown); and 6, a photo-interruptive type sensor (hereinafter referred to as "roller-position sensor") for detecting a home position of the print-sheet separation roller 5.

It should be noted that the position of the intermediate board 3 in FIG. 1 corresponds to a stand-by status where it is pivoted in a counterclockwise direction and stopped by a cam (not shown) provided in the mechanically driven unit (not shown), controlling the movement of the intermediate board 3. When the cam is disengaged, the intermediate board 3 rotates in the clockwise direction, and the intermediate board 3 or the print sheet comes into contact with the outer circumferential portion of the print-sheet separation roller 5. Further, the movement of the intermediate board 3 and the position of an aspherical portion of the print-sheet separation roller 5 are in synchronization with each other.

Numeral 7 denotes a print-sheet convey roller which rotates in the counterclockwise direction by the mechanically driven unit (not shown); and 8, a print-sheet convey rod, provided around the print-sheet convey roller 7, in contact with the print-sheet convey roller 7 by a spring (not shown). The print-sheet convey roller 7 and the print-sheet convey rod 8 clamp the print sheet at a position where they are in contact with each other, and convey the print sheet in the leftward direction in FIG. 1 (hereinafter referred to as "subscanning direction"). Numeral 9 denotes an exchangeable (disposable) type ink cartridge integrating a printhead in accordance with the ink-jet printing method and an ink tank as an ink reservoir; and 10, a carriage to which the ink cartridge 9 is detachably attached.

The printing surface of the ink cartridge 9 is at the bottom part of the ink cartridge 9 in FIG. 1, and it has a plurality of nozzles arrayed in a transverse direction, forming the printing-surface. Upon printing, the ink cartridge 9 is moved in an orthogonal direction to the nozzle arrangement direction (i.e., vertical direction with respect to the figure; hereinafter referred to as "main-scanning direction"). Printing on a printing area for print width is performed by selectively discharging ink from those nozzles. Thereafter, the print sheet is shifted by the print width in the subscanning direction. Thus printing is made on the print sheet by repeating this print operation (This printing method is called a "multiscan method").

A residual-ink detection sensor (ink sensor), comprising a photosensor, is attached to the carriage 10, for detecting the amount of residual ink in the ink cartridge 9. The detection direction of the ink sensor is approximately the same as the main-scanning direction of the ink cartridge 9. Since the ink sensor is attached to the carriage 10, the ink sensor moves with the ink cartridge 9 as the carriage 10 moves. Note that this movement will be described in detail later.

Numerals 12 and 13 denote guide rails for assisting the reciprocating movement of the carriage 10 :6 in the main-scanning direction. The carriage 10 is attached to these guide rails 12 and 13 such that it is movable in the main-scanning direction, and is reciprocated by the mechanically driven unit (not shown). Numeral 14 denotes a platen, opposing to the printhead, for holding the print sheet to face the printhead, and maintaining the distance from the print sheet to the printhead at the printing position. Numeral 15 denotes a paper discharge roller; and 16, a paper discharge rod. The paper discharge rod 16 is biased by a press member (not shown) against the paper discharge roller 15. The paper discharge roller 15 and the paper discharge rod 16 discharge the print sheet while holding the print sheet at a contact portion between them. Numeral 17 denotes a cover (print-sheet cover) which opens downward with a bottom portion of the apparatus as its pivotal axis.

Next, the construction of a reading unit of the facsimile apparatus will be described.

Numeral 20 denotes a reading separation roller which rotates in the counterclockwise direction by the mechanically driven unit (not shown) and conveys each of plurality of originals in the leftward direction in FIG. 1 one by one; 21, a separation piece, comprising of high-friction material such as rubber, biased by a press member (not shown) against the reading separation roller 20, for separating the plurality of originals one by one; 22, a contact type line image sensor (hereinafter referred to as "image sensor") which reads images on the originals and converts the read image information into electric signals; 23, a CS spring; and 24, a white CS roller which rotates in the clockwise direction by the mechanically driven unit (not shown). The CS spring 23 presses the image sensor 22 against the CS roller 24. The CS roller 24 brings the original into tight contact with the entire reading surface of the image sensor 22, conveys the original in the leftward direction in FIG. 1, and functions as a background in original reading.

Numeral denotes an original guide, fixed to the frame 1 that supports (as a part of the apparatus body) the reading unit and an operation panel (described later), for guiding the back surface of the original; 26, an original guide, fixed to the original guide 25, for guiding the front surface of the original; 27, an operation circuit board having operation switches; and 28, the operation panel, to which the operation circuit board 27 is fixed. The operation panel 28 itself is fixed to the original guide 25.

Numeral 30 denotes a power unit comprising a power transformer, a capacitor and the like; and 31, an electric control board, attached to the frame 1, for controlling the operation of the overall apparatus. The electric control board 31 is connected with all wires and cables from electric devices, divided into the respective parts, components (the image sensor 22, the operation circuit board 27, the power unit 30, the ink cartridge 9, respective drive motors (not shown), the roller position sensor 6, and respective sensors (not shown)). Note that various sensors including a sensor for detecting presence/absence of a print sheet, which are not described here, are directly integrated onto the electric control board 31 without using wires and cables. Further, all the external interfaces (e.g., a public telephone line network interface, an auxiliary sub-telephone interface, an external sub-telephone interface, and a personal-computer interface such as a centronics interface) are connected to the electric control board 31.

Figure 2:
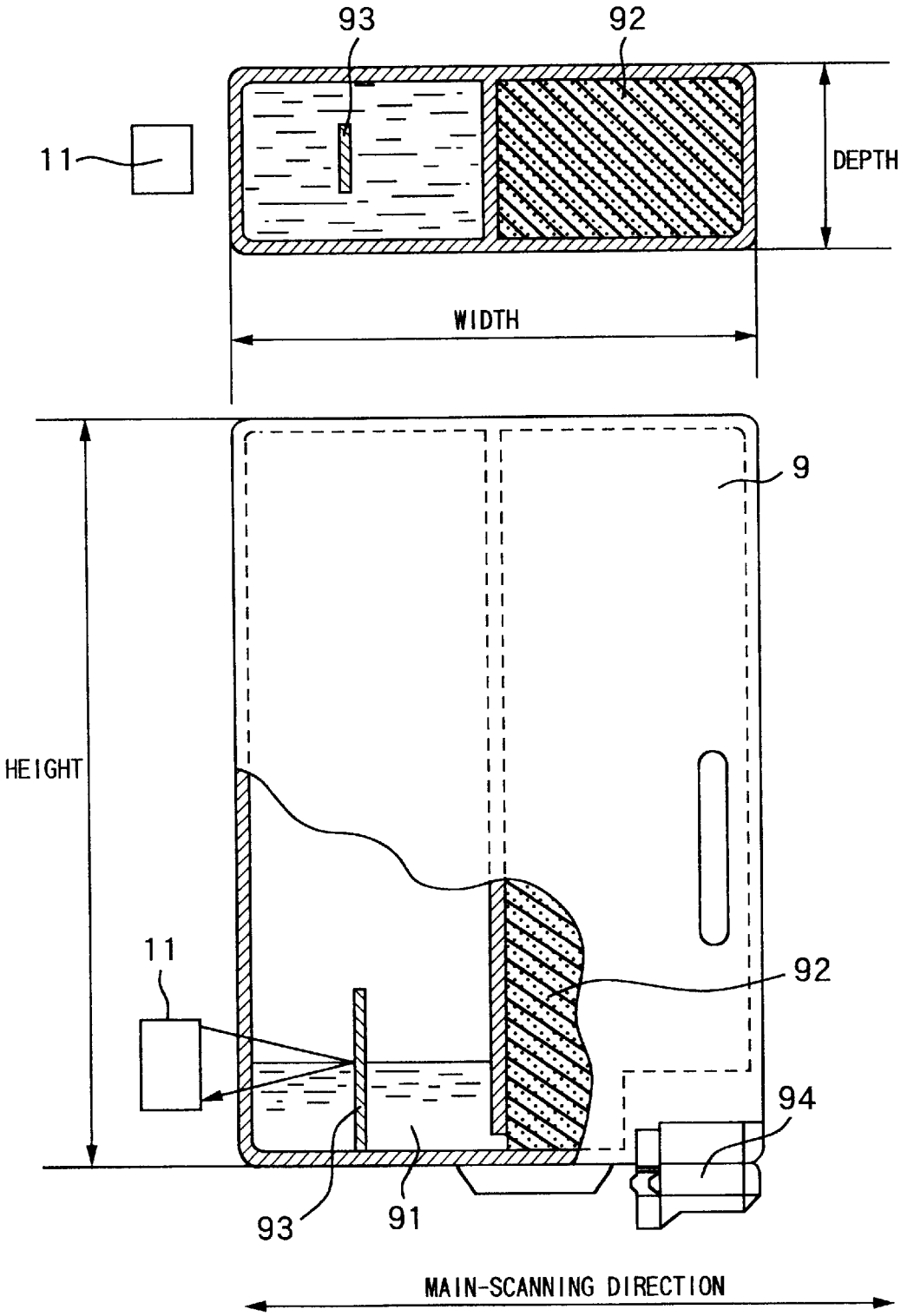
FIG. 2 is a partial-cutaway view showing a detailed construction of an ink cartridge 9.

FIG. 2 is a partial-cutaway view showing the detailed construction of the ink cartridge 9. In FIG. 2, numeral 11 denotes a reflection type photosensor (hereinafter referred to as "photosensor"); 91, ink; 92, a sponge; 93, a reflection board for reflecting light from the photosensor 11; and 94, a printhead. FIG. 2 especially shows status where the carriage 10 and the ink cartridge 9 to be mounted on the carriage 10 stand still. Accordingly, the surface of the ink 91 is smooth without trembles.

It is apparent from FIG. 2, the reflection board 93 is provided around the bottom of the ink cartridge, at a position near a ink-cartridge side wall, around which the photosensor 11 for the reflection board 93 is provided. This arrangement of the reflection board 93 around the photosensor 11 is intended to enhance the intensity of reflected light to be received by the photosensor 11, and improve S/N ratio in residual-ink detection. The interval (detection gap) between ink-cartridge side wall on the photosensor 11 side and the reflection board 93 is set, in consideration of the ink-surface tension and the water repellent relation among the side wall, the ink, and the reflection board, so as not to gather ink between the photosensor 11 and the side wall. This interval should preferably be 2 to 4 mm for more accurate residual-ink detection.

Further, right space and left space with respect to the reflection board 93 provided as above are not separate reservoirs but are connected. In other words, as shown in FIG. 2, the depth of the reflection board 93 does not occupy the full depth of the ink cartridge 9 but occupies a part of the depth of the ink cartridge 9. That is, the reflection board 93 is positioned around the central portion of the depth. This arrangement renders the same change to the ink surface between the reflection board 93 and the photosensor 11 as that to the ink surface of the ink within other parts of the ink cartridge. In addition to this arrangement, a hole may be provided around the bottom of the reflection board 93 to obtain the same level of the ink surface, on the both sides, around the reflection board 93.

When the ink cartridge 9 is filled up with the ink 91, the photosensor 11 hardly detects light reflected from the reflection board 93 since the light is interrupted by the ink 91. At this time, the output current from the photosensor 11 is approximately zero. On the other hand, when the ink cartridge has little or no ink 91, the photosensor 11 detects the light reflected from the reflection board 93, and as a result, outputs current corresponding to the reflection light intensity.

Electrical Construction

Figure 3:
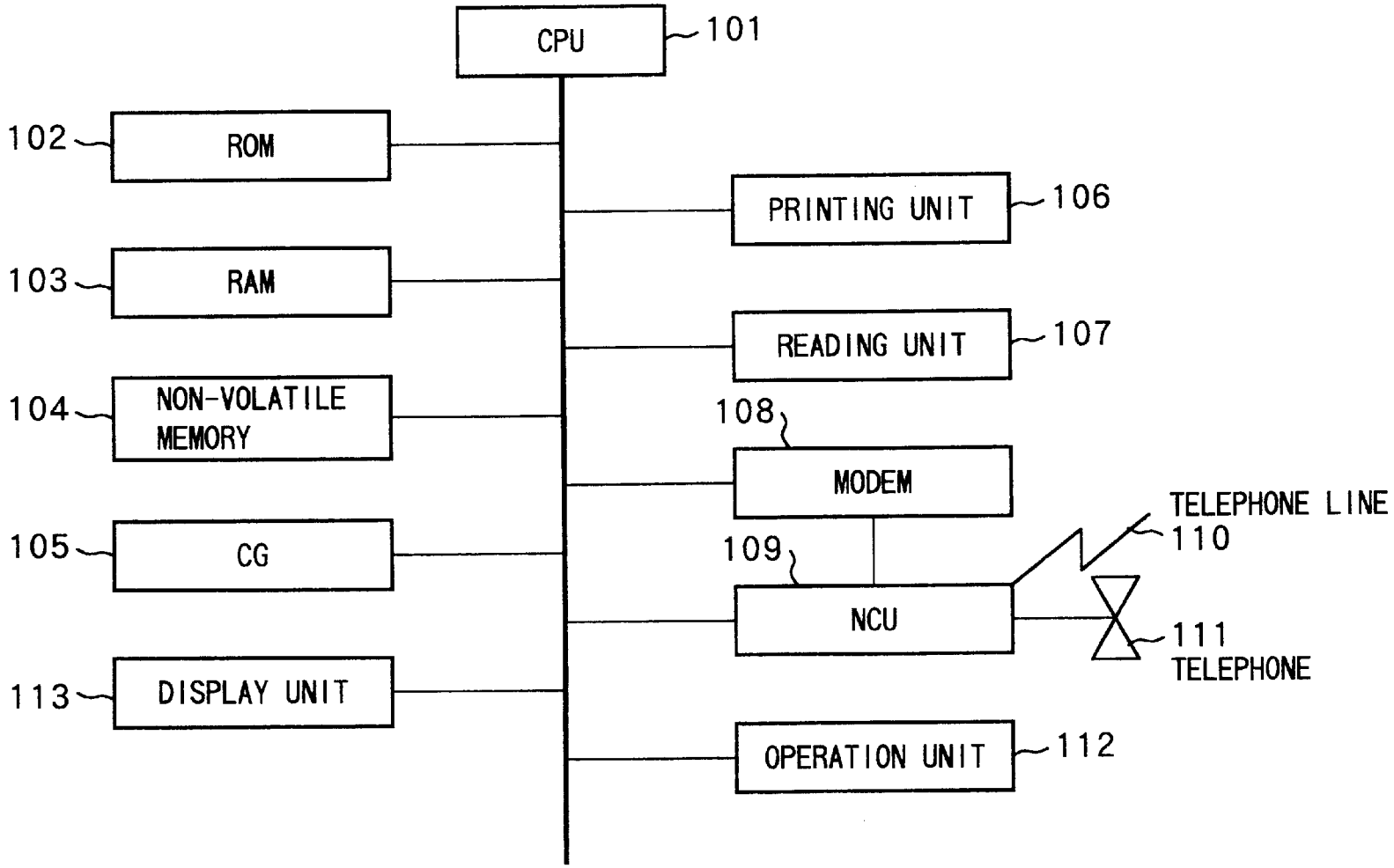
FIG. 3 is a block diagram showing the electrical construction of the facsimile apparatus shown in FIG. 1.

FIG. 3 is a block diagram showing the electrical construction of the facsimile apparatus in FIG. 1. In FIG. 3, numeral 101 denotes a CPU comprising a microprocessor or the like; 102, a ROM for storing control programs and processing programs executed by the CPU 101; 103, a RAM used as a storage area for storing image data for facsimile transmission/reception or read image data for copying processing and as a work area for the CPU 101 to execute the control programs and the processing programs; 104, a non-volatile memory it comprising of a DRAM or an SRAM having a backup power source, or an EEPROM, for storing information even not supplied with power from the power unit 30.

Numeral 105 denotes a character generator (CG) which generates character patterns in accordance with character codes, represented based on a code system such as JIS codes or ASCII codes; 106, the printing unit having the construction as described in FIG. 1; 107, the reading unit having the construction as described in FIG. 1; 108, a MODEM; 109, a network control unit (NCU); 110, a telephone line; 111, a telephone; 112, an operation unit having a part of the operation panel 28 of the operation circuit board 27, as described in FIG. 1; and 113, a display unit having an LCD, LEDs and the like, with a part of the operation panel 28 of the operation circuit board 27, as described in FIG. 1.

The CPU 101 controls the ROM 102, the RAM 103, the non-volatile memory 104, the CG 105, the printing unit 106, the reading unit 107, the MODEM 108, the NCU 109, the operation unit 112, and the display unit 113.

The RAM 103 is used for storing binary image data read by the reading unit 107 or binary image data to be printed by the printing unit 106. Also, the RAM 103 is used for storing encoded image data to be modulated by the MODEM 108 and outputted onto the telephone line 110 via the NCU 109, and encoded image data obtained from demodulating, via the NCU 109 and the MODEM 108, an analog image signal received via the telephone line 110. The non-volatile memory 104 is used for storing data to be held regardless of presence/absence of power supply (e.g., abbreviated telephone numbers). The CG 105 generates character pattern data corresponding to input codes in accordance with necessity, under the control of the CPU 101.

The electric circuit of the printing unit 106, comprising a DMA controller, the ink-jet printhead, a CMOS logic IC and the like, reads the image data stored in the RAM 103, and print-outputs the data. On the other hand, the electric circuit of the reading unit 107, comprising a DMA controller, an image processing IC, an image sensor, a CMOS logic IC and the like, binarizes the image data read from the image sensor 22 and sequentially outputs the binary data to the RAM 103, under the control of the CPU 101. Note that the status of an original which is set with respect to the reading unit 107 can be detected by an original detection unit (not shown) using a photosensor provided on an original convey path.

The MODEM 108, comprising a G3/G2 MODEM, a clock generator connected to the MODEM and the like, modulates encoded transmission data stored in the RAM 103 and outputs the data onto the telephone line 110 via the NCU 109, otherwise, inputs, via the NCU 109, an analog image signal received via the telephone line 110, demodulates the input signal to obtain encoded received data, and stores the data into the RAM 103, under the control of the CPU 101. The NCU 109 switches the connection of the telephone line 110 to the MODEM 108 or to the telephone 111, under the control of the CPU 101. The NCU 109 has a detection circuit for detecting a calling signal (CI). When the calling signal is detected, the NCU 109 sends an incoming-call signal to the CPU 101.

The telephone 111 is integrated with the facsimile apparatus main body, comprising a handset, a speech network, a dialer, ten-keys, single-touch keys and the like. The operation unit 112 comprises a start key to start image transmission/reception, a resolution selection key to switch resolution of the facsimile image upon transmission/reception to fine mode, standard mode and the like, a mode selection key to designate operation mode upon automatic reception and the like, ten-keys and single-touch keys for dialing, and the like. The display unit 113 comprises an LCD module including a seven-segmented LCD for time display, an iconic LCD for displaying icons representing various modes, a matrix LCD for displaying 5×7 dots (one character)×one line, LEDs, and the like.

Next, the electrical construction of a residual-ink detection unit provided at the printing unit 106 will be described.

Figure 4:
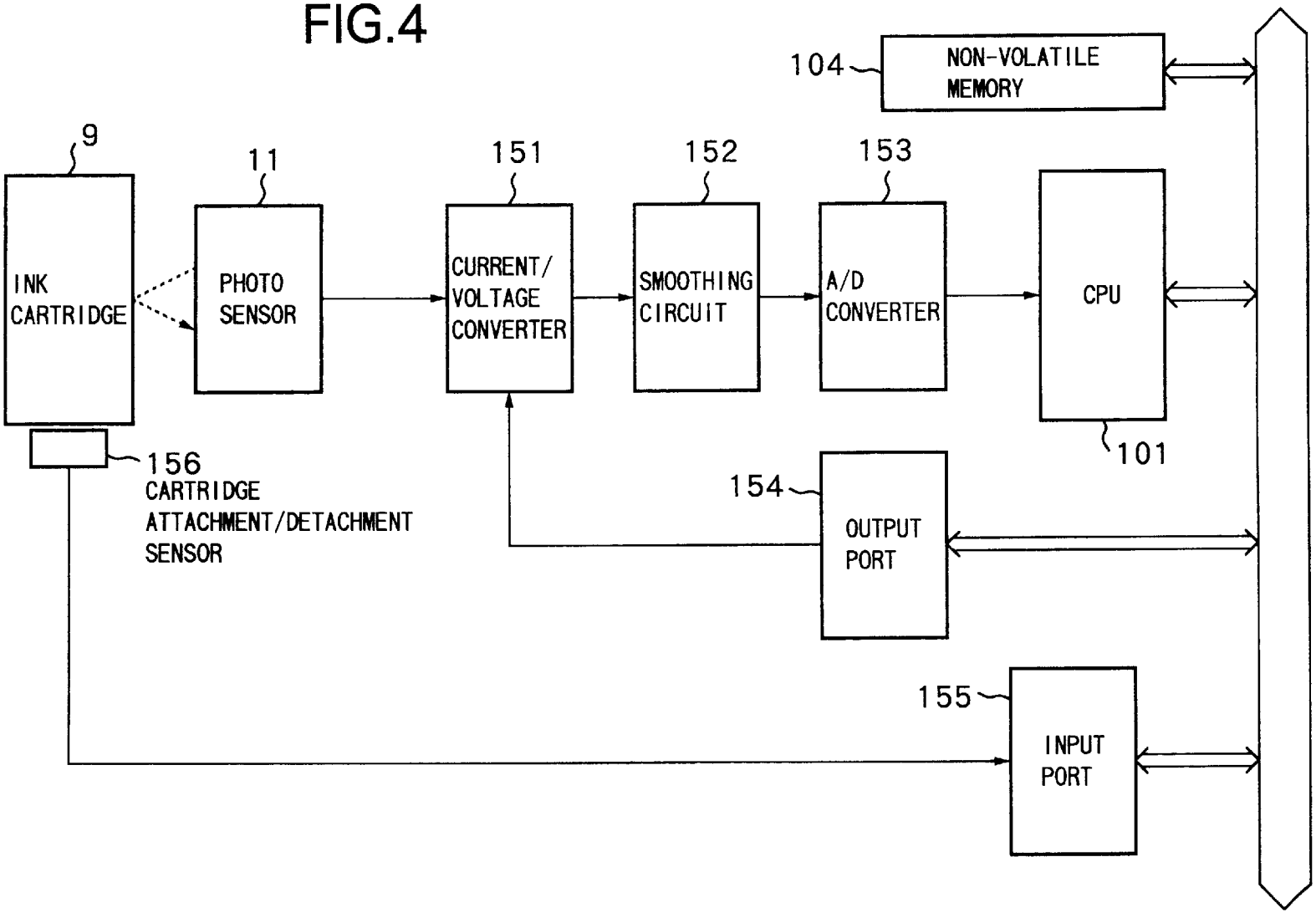
FIG. 4 is a block diagram showing the electrical construction of a residual-ink detection unit.

FIG. 4 is a block diagram showing the electrical construction of the residual-ink detection unit.

In FIG. 4, numeral 151 denotes a current/voltage converter for converting current into a voltage corresponding to the intensity of the output current from the photosensor 11; 152, a smoothing circuit which eliminates noise caused by the movement of the ink cartridge 9, and minimizes variation in output voltage due to trembles of the ink surface also caused by the movement of the ink cartridge 9; 153, an A/D converter; 154, an output port for supplying a switching signal (described later) to the current/voltage converter 151 in accordance with a control signal from the CPU 101; 155, an input port to input outputs from various sensors and output the signals to the CPU 101; and 156, a cartridge attachment/detachment sensor for detecting whether the ink cartridge 9 is attached to the carriage 10 or not. Note that the current/voltage converter 151 can vary the ratio of current/voltage conversion by the switching signal from an external device (CPU 101), and the output from the A/D converter 153 is inputted into the CPU 101.

Figure 5:
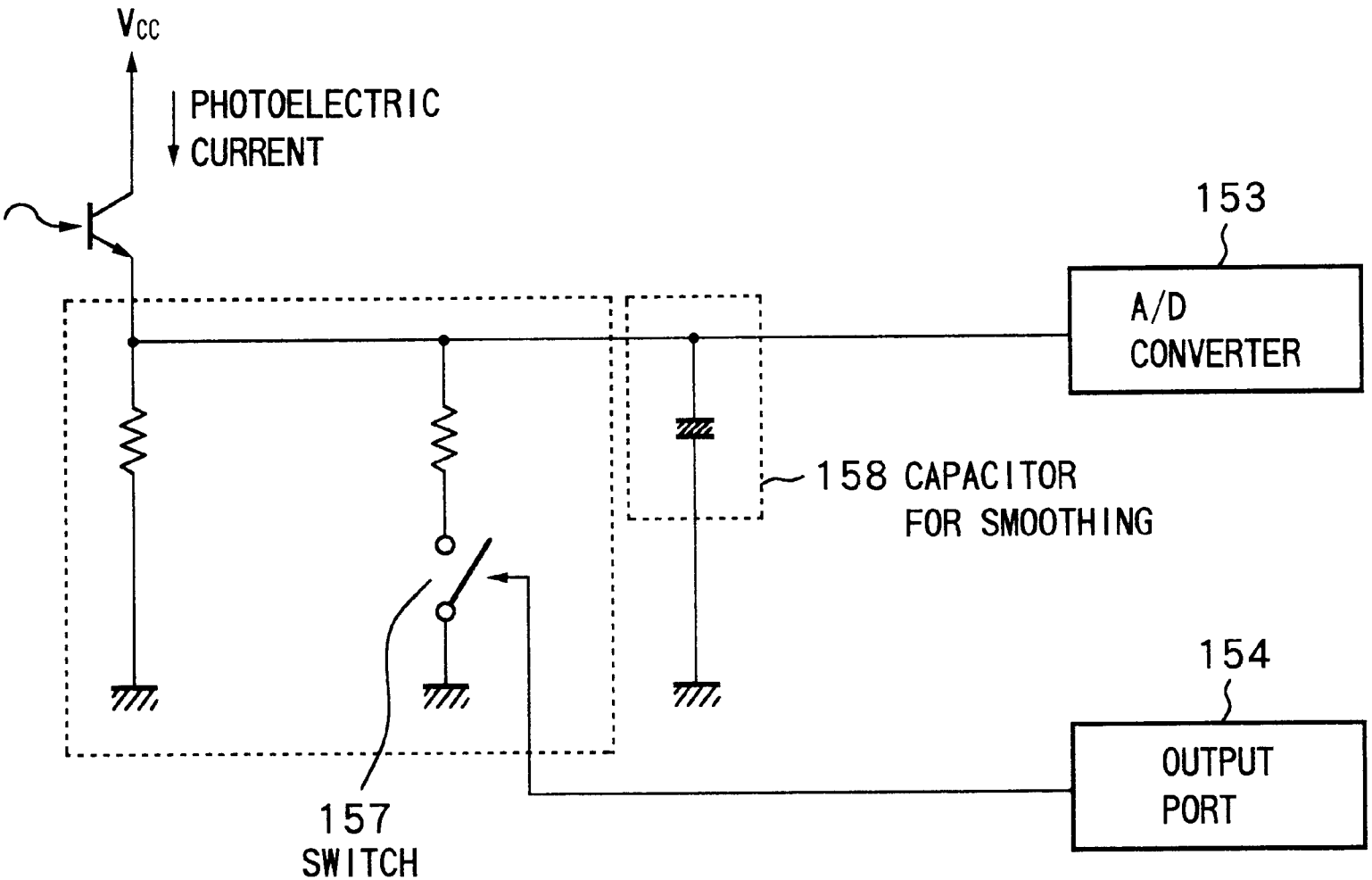
FIG. 5 is a block diagram showing a detailed construction of a current/voltage converter 151.

FIG. 5 is a block diagram showing the detailed construction of the current/voltage converter 151. As apparent from FIG. 5, when the ink cartridge 9 has sufficient ink, the output from the photosensor 11 is at a low level, consequently, a low-level signal is inputted into the A/D converter 153. On the other hand, when the ink cartridge 9 has little or no ink, the output from the photosensor 11 is at a high level, consequently, a high-level signal is inputted into the A/D converter 153. Further, a switch 157 is opened/closed (ON/OFF) in accordance with an ON/OFF signal from the output port 154.

When the switch 157 is closed (ON), as the resistance is connected in parallel, the input voltage to the A/D converter 153 is smaller than that when the switch 157 is opened (OFF).

In FIG. 5, numeral 158 denotes a capacitor for smoothing. The capacitor 158 functions to smooth the signal with the above resistance element.

<Print Operation of Apparatus>

Mechanical Operation

When print operation is required for copying an original or printing a received facsimile image signal, the mechanically driven unit (not shown) rotates to drive the print-sheet separation roller 5 in the clockwise direction. At the same time, the operation of a cam as a part of the mechanically driven unit releases downward depressing of the intermediate board 3. The intermediate board 3, then pressed by the spring 4, pivots to bring the top of the plural print sheets on the ASF chassis 2 into contact with the print-sheet separation roller 5. Further, as the print-sheet separation roller 5 rotates, only the top print sheet is conveyed in a left-downward direction, to a contact point between the print-sheet convey roller 7 and the print-sheet convey rod 8. In the meantime, print-sheet detection sensor (not shown) detects a top-end position of the print sheet, then a print-sheet convey amount is calculated based on this detection result.

The print sheet, held between the print-sheet convey roller 7 and the print-sheet convey rod 8, is further conveyed in the leftward direction. As the rotation speed of the print-sheet separation roller 5 is a little faster than that of the print-sheet convey roller 7, the friction force between the print sheet and the print-sheet separation roller 5 does not become load against the convey force of the print-sheet convey roller 7.

As the print sheet is conveyed, it is also held between the print-sheet discharge roller 15 and the print-sheet discharge rod 16. The print-sheet convey speed of this pair of rollers is faster than that of the print-sheet convey roller 7, but the convey force of the pair of rollers is far less than that of the print-sheet ic: convey roller 7. Therefore, the print-sheet convey amount is determined by the print-sheet convey roller 7, and the print sheet is lightly tensed.

As the print-sheet separation roller 5 rotates one cycle and the roller position sensor 6 detects the home position of the print-sheet separation roller 5, the print-sheet separation roller 5 stops. Immediately before this operation, the intermediate board 3 is again pressed downward by the cam (not shown) as in the stand-by status. Thereafter, the rotations of the print-sheet convey roller 7 and the print-sheet discharge roller 14 are reversed, then the print sheet is conveyed in the reversed direction, in accordance with the print-sheet convey amount evaluated from the point where the top end of the print sheet has been detected by the print-sheet detection sensor, thus positioning of the print sheet is made such that the top end of the print sheet comes to the print position of the printhead.

Then, printing is performed by scanning the carriage 10 in the main-scanning direction while selectively discharging ink from the nozzles in accordance with image data. As one scanning in the main-scanning direction (forward scanning) of the carriage 10 has been completed, the print-sheet convey roller 7 and the print-sheet discharge roller 15 are rotated in the counterclockwise direction (regular rotation), to convey the print sheet by a predetermined amount (the print width of the printhead) in the leftward direction while the carriage 10 moves backward. Thereafter, printing is performed again by scanning the carriage 10 in the main-scanning direction (forward scanning) while selectively discharging the ink from the nozzles. This operation is repeated to form a print image over the print sheet. Finally, as the print-sheet detection sensor detects the rear end of the print sheet, print operation for one print sheet is finished.

When printing for a plurality of print sheets is performed, the above operation is repeated for the number of the print sheets.

Print Control (FIG. 6 to FIG. 11)

The print control based on residual-ink detection, performed by the CPU 101 in cooperation with the residual-ink detection unit will be described with reference to the flowchart of FIG. 6. In the facsimile apparatus of this embodiment, when printing is required for printing a received facsimile image signal or for copying an image original by copying instruction, the following processing is performed.

(1) Outline of Print Control

Figure 6:
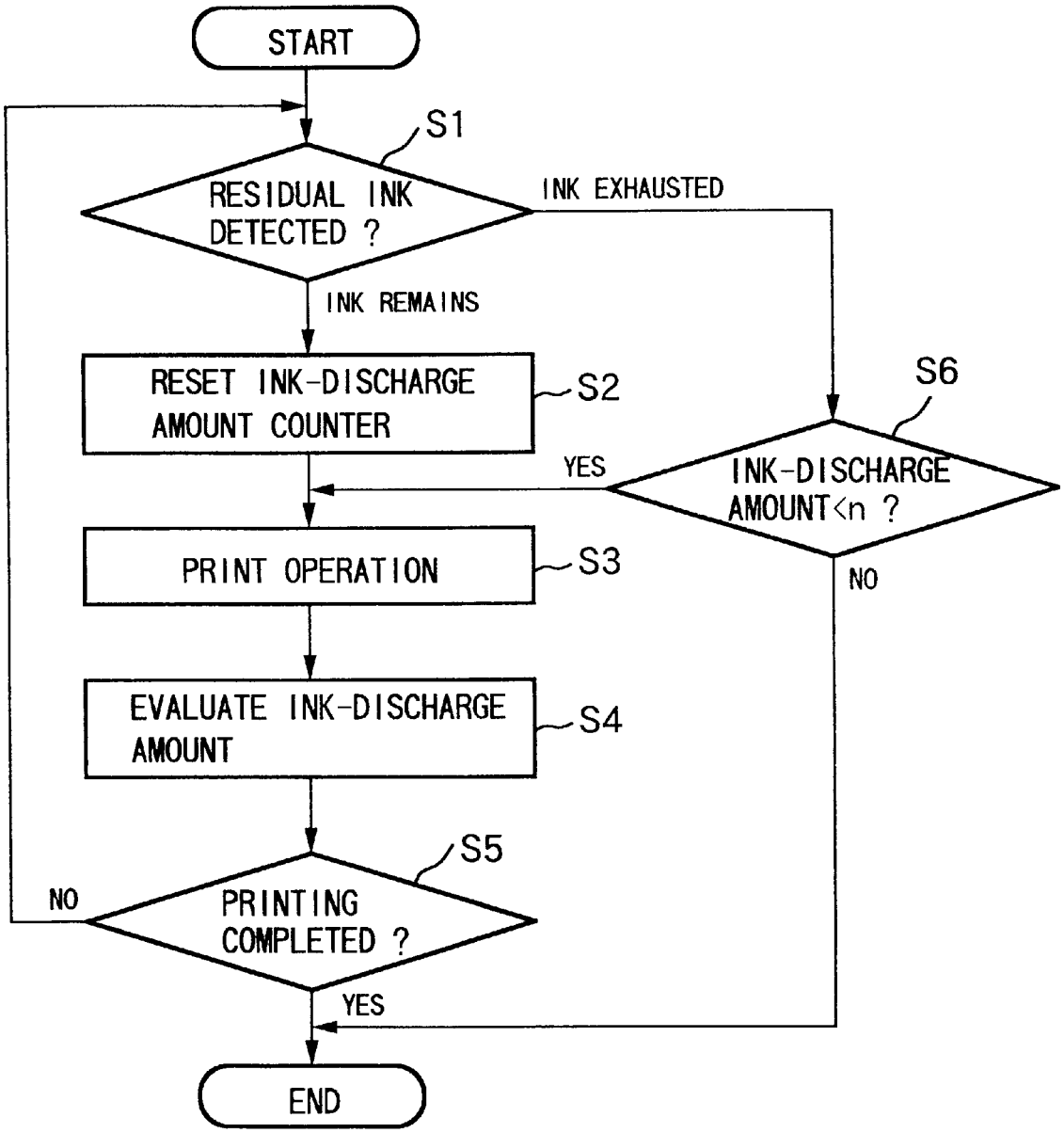
FIG. 6 is a flowchart showing the overall print control processing performed in accordance with an amount of residual ink.

At step S1 in FIG. 6, whether or not the ink remains is examined by using the result of detection by the residual-ink detection unit. If it is determined that the ink remains, the processing proceeds to step S2, while if it is determined that the ink is exhausted, the processing proceeds to step S6. Note that the residual-ink detection will be described in detail later.

At step S2, a count value (CNT) of an ink-discharge amount counter (hereinafter simply referred to as "counter") set in the non-volatile memory 104 is reset. This counter is used for counting the ink-discharge amount in print operation after it is determined that the ink is exhausted. When ink remains, this counter is not used, thus the count value is reset. At step S3, printing (here this means printing for the print width of the printhead, performed by one scanning of the printhead in the main-scanning direction) on a print sheet is performed.

At step S4, the counter evaluates the ink-discharge amount by examining the number of pixels for actual ink discharge for one print operation (hereinafter referred to as "number of print dots"). At step S5, whether or not the series of print operation has been completed is examined. If it is determined that the print operation has been completed, the processing ends, while if it is determined that the print operation is continued, the processing returns to step S1 to repeat the above operation.

At step S6, the ink-discharge amount, i.e., the count value of the counter (CNT) is compared with a predetermined threshold value (n). If CNT<n holds, the processing proceeds to step S3, while if CNT≧n holds, the processing ends.

As the residual-ink detection unit directly detects a residual-ink amount of the liquid ink, even though it is determined, due to the structure of the ink cartridge as shown in FIG. 2, that the ink is exhausted, printing is still possible because there is a small amount of ink reservoir and ink remaining in the sponge 92. Accordingly, to obtain the available amount of ink for further printing, it is necessary to perform print control such that printing can be made after it is determined that the ink is exhausted (hereinafter referred to as "further-discharging control"). This control is particularly indispensable to an apparatus using a disposable type ink cartridge as the present embodiment.

For this purpose, the predetermined threshold value (n) is determined by evaluating a residual-ink amount in advance when the residual-ink detection unit detects that the ink is exhausted. Further, this value allows printing in any case, in consideration of difference in residual-ink detection precision, variation of ink-discharge amount due to temperature change of environment where the apparatus is installed, variation of ink-discharge amount due to difference in product quality of each printhead, change of ink-discharge amount depending on a print pattern or a print history. In a case where the printing unit 106 has function of preliminary discharge of ink and/or suction (suction recovery) of ink from discharge orifices (nozzles) by a pump for maintaining discharging performance, it may be arranged such that the discharged ink amount or sucked ink amount is evaluated and the evaluation result is fed-back to the determination of the predetermined threshold value (n).

Although not directly concerned with the feature of the present embodiment, processing to stop printing will be briefly described. Normally, upon determination on stoppage of printing, it is considered that printing has not been completed on the current print sheet, then data reception is switched to alternative processing to store the received data (e.g., in facsimile image signal receiving) into a memory from the head line or head scan of the corresponding page, so that printing can be restored. Especially, since the receiving side does not have an original in facsimile image reception, it is necessary to handle received data to be printed at any time.

As indicated in the flowchart of FIG. 6, the printing stoppage processing is immediately performed, however, print control may be performed such that the printing on the current page is continued on any condition, and at a point of completion of the printing of the page, the process ends.

On the other hand, when printing accompanying copying operation is performed, a user is near the apparatus and can take appropriate actions. In this case, different from the above facsimile image reception, it may be arranged such that only a warning message is displayed on the display unit 113 to notify the user of the shortage of ink, then the printing is continued by the end of the current print sheet, and handling thereafter is left to the user.

However, in any case, the present apparatus is capable of two print operations, facsimile reception and copying, and when such print operation occurs is not known in advance. Therefore, considering that facsimile reception operation may occur at any time, the detection of residual-ink amount, the evaluation of ink-discharge amount, the comparison of the ink-discharge amount with the predetermined threshold value are always necessary. It is preferable that as soon as it is determined that the ink-discharge amount exceeds the predetermined amount, a warning is given to the user.

Since a reflection type photosensor is utilized for residual-ink detection in the present embodiment, the photosensor may have erroneous operation when it receives an intense unexpected incident light such as sunlight or spotlight.

In the structure of this apparatus, the printing unit 106 necessarily has an opening to discharge print sheet. In printing in accordance with an ink-jet printing method, if printed surface of a print sheet is in contact with a part of the apparatus such as a guide, the printed image might be blurred, which causes degradation of printing quality. Accordingly, it is preferable that the printed sheet is discharged immediately after printing, and the distance from the printhead to the print-sheet discharge orifice (i.e., the opening) is short. On the other hand, since there is already the residual-ink detection unit around the printhead, the external light incident from the opening may easily enter the photoreceptor of the photosensor 11.

As shown in FIG. 1, in the structure of this apparatus, the printing unit 106 typically performs printing by discharging ink from upper positions downward and conveying a print sheet in a horizontal direction. For this printing, the ink cartridge 9 is at a relatively higher position to the print-sheet discharge orifice. This means the photosensor 11 is also at a relatively higher position to the print-sheet discharge orifice. By virtue of this structure, the photosensor 11 seldom receives external light directly, but may receive reflected light from a desk on which the apparatus is placed or a discharged print sheet. However, such indoor light having a weak intensity cannot be a main cause of erroneous judgment of residual-ink detection.

Accordingly, light that might cause a problem is only sunlight, especially diagonally incoming sunlight with a small incident angle, i.e., sunlight that may impinge upon the apparatus for a short period (e.g., an hour) in mornings and evenings.

Thus, in the flowchart shown in FIG. 6, in a case where further-discharging control is performed after determination is made that ink is exhausted, the residual-ink detection is performed again. When the residual-ink detection is performed for the second time, if determination is made that ink still remains, it is considered that the original determination of "no residual ink" is erroneous, thereafter the further-discharging control is stopped, that is, the processing proceeds to step S2 in FIG. 6 where the count value (CNT) is reset, so that the apparatus returns to the normal print operation. By this process, it is possible to stop the operation caused by erroneous determination of residual ink due to, e.g., accidentally-incoming light.

In addition, taking into consideration of the case where an ink cartridge is exchanged with a new one during the further-discharging control and thus the control is no longer necessary, an additional processing step may be included. In such additional processing, whether or not an ink cartridge is exchanged is determined, and according to the result of the determination, the further-discharging control is stopped and the count value (CNT) is reset. The additional processing can be performed on the basis of the output from the cartridge attachment/detachment sensor 156. Note that if manufacturing cost is to be considered, instead of utilizing the cartridge attachment/detachment sensor 156, for instance, a contact point for detecting the cartridge may be provided at an electrical contact point between the ink cartridge 9 and carriage 10, so that the contact point serves as a sensor. The processing is realized by adding a step between steps S1 and S6 in the flowchart in FIG. 6, where determination is made whether or not a new ink cartridge is set, and if setting of a new ink cartridge is not detected in the determination step, the processing proceeds to step S6, while if the new ink cartridge setting is detected, the processing proceeds to step S2.

It should be noted that it is preferable to perform control processing for imperatively suspending print operation in a case where the determination of ink cartridge exchange cannot be made due to unexpected power failure.

(2) Residual-Ink Detection

As described above, residual-ink detection is performed by using the reflection board 93 provided in the ink cartridge 9 and the photosensor 11. That is, the photosensor 11 emits light, the reflection board 93 reflects the light, then the reflected light is received by the photosensor 11, and the residual-ink amount is determined by the intensity of the reflection light received by the photosensor 11. As shown in FIG. 2, the photosensor 11 and the reflection board 93 are both provided in parallel to the moving direction (main-scanning direction) of the carriage 10, and the photoreceptor surface of the photosensor and the reflection surface of the reflection board 93 are perpendicular to the main-scanning direction.

When the carriage 10 performs print operation with the printhead discharging ink, that is, when the carriage 10 scans forward (this direction is referred to as a "regular direction") from its home position as an initial stop position, the carriage 10 starts acceleration from a velocity (0). When the velocity of the carriage 10 reaches a predetermined velocity (X), the carriage 10 moves at a constant velocity. While the carriage moves with a constant velocity, ink is discharged from the printhead, performing print operation. When the print operation is completed, the carriage 10 decelerates from the velocity (X) with a predetermined negative acceleration, and stops at an opposite side from the home position.

Figure 7:
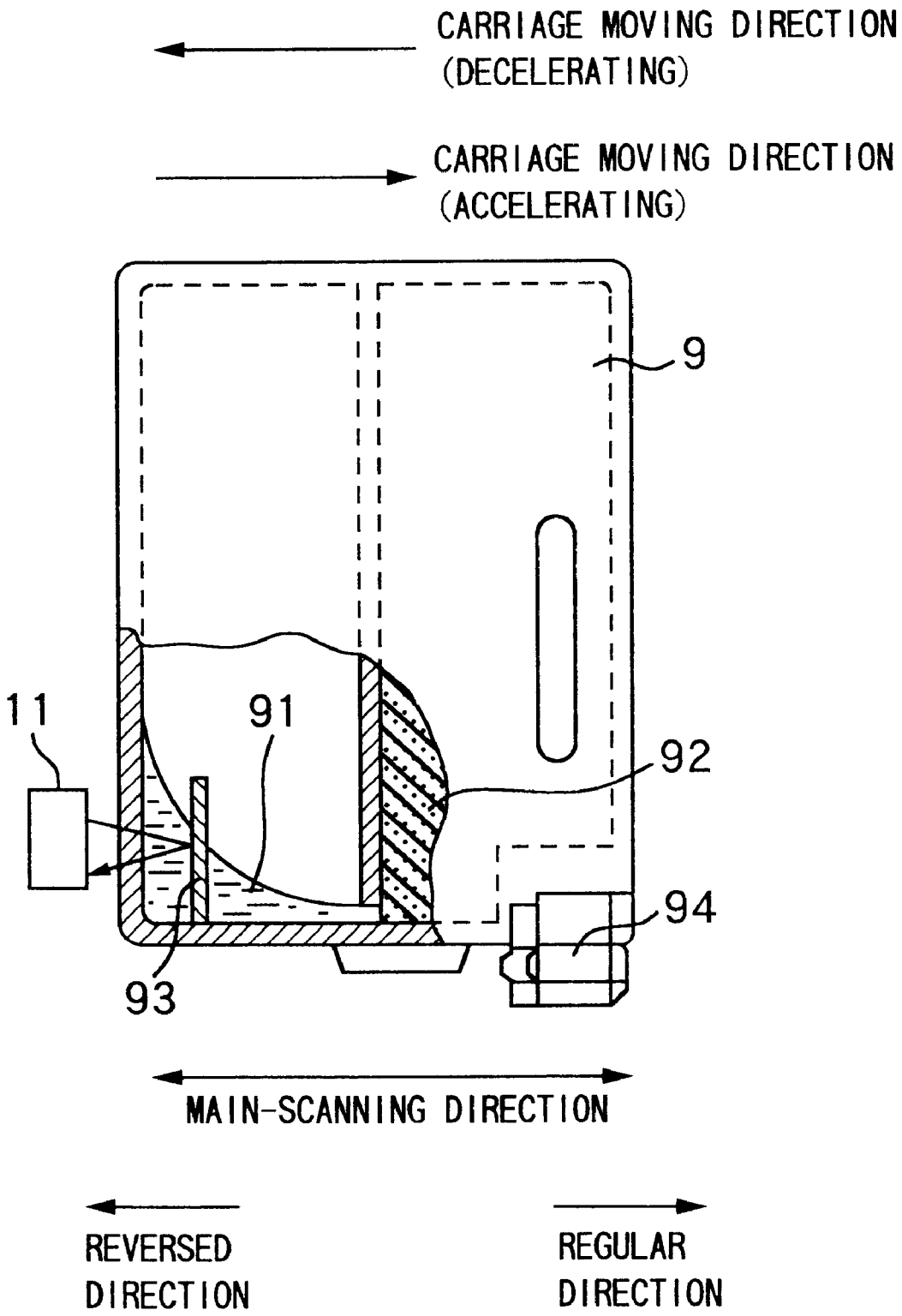
FIGS. 7 and 8 illustrate a condition of an ink surface in the ink cartridge 9 while carriage movement is accelerated/decelerated.
Figure 8:
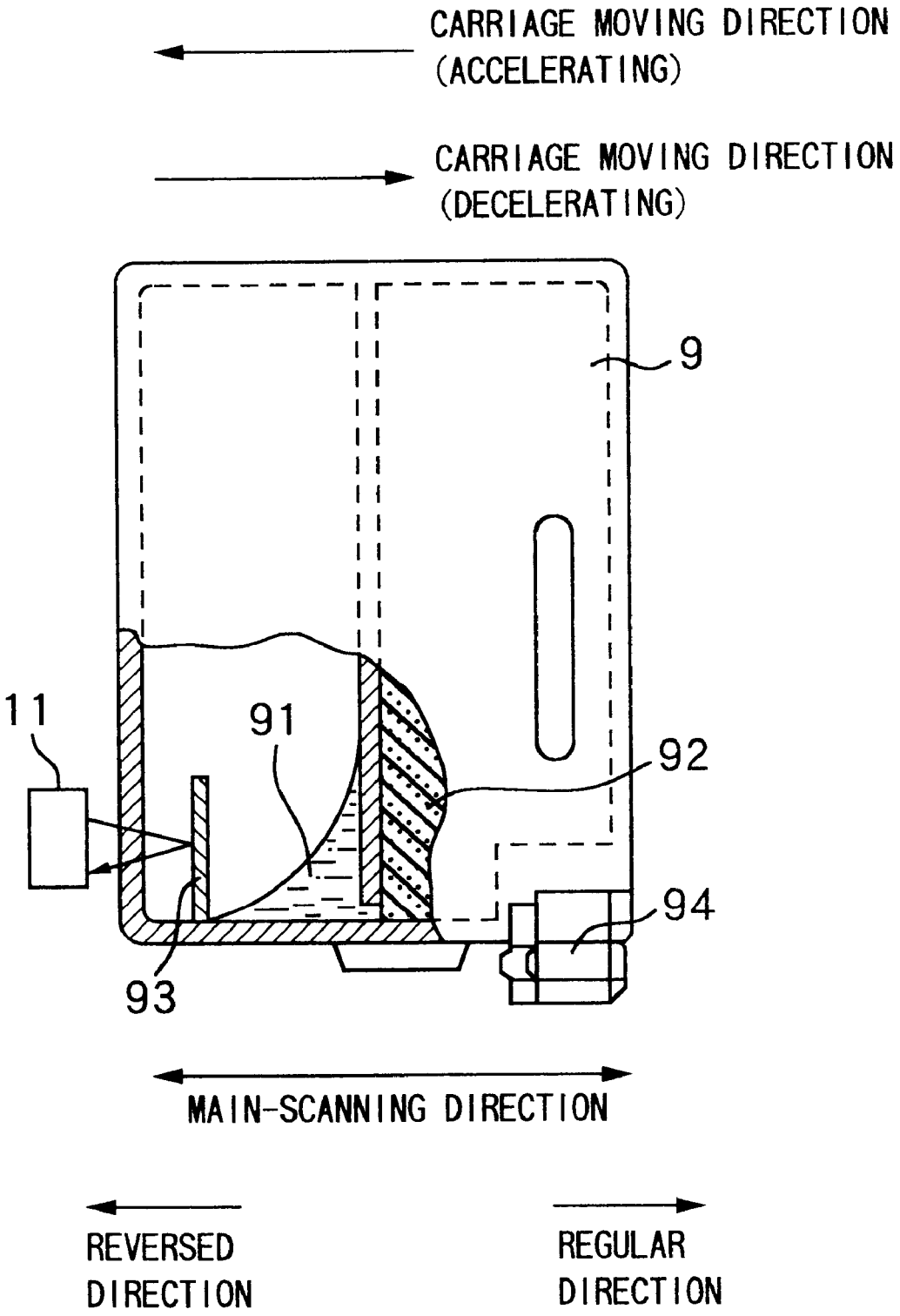

As the carriage 10 moves as above, acceleration (inertia) acts on the ink cartridge 9. That is, in acceleration at the time of the regular direction movement (forward scanning) and in deceleration at the time of the reversed direction movement (backward scanning), the ink surface in the ink cartridge 9 is as shown in FIG. 7. On the other hand, in deceleration at the time of the regular direction movement (forward scanning) and in acceleration at the time of the reversed direction movement (backward scanning), the ink surface in the ink cartridge 9 is as shown in FIG. 8. Note that when the carriage 10 is moving at a constant velocity or stands still, no acceleration acts on the ink cartridge 9, therefore, the ink surface of the ink cartridge 9 at this time is as shown in FIG. 2.

Thus, the ink surface in the ink cartridge 9 (to be more exact, the interval between the side wall of the ink cartridge 9 on which the photosensor 11 is provided outside and the reflection board 93) changes in correspondence with the movement of the carriage 10.

Accordingly, even with the same amount of remaining ink, determination of ink shortage is made at a certain timing, or determination of ink-remaining is made at some other timing, depending on the change in the ink surface. In other words, in accordance with the change of the ink surface, there is a case where determination is apparently made that ink does not remain even though ink still remains, or a case where determination of ink-remaining is made although ink is exhausted to the extent that it should be determined that ink does not remain. Considering the conditions shown in FIGS. 2, 7 and 8, the condition illustrated in FIG. 7 apparently has the largest amount of remaining ink; and the condition in FIG. 8, the smallest. Therefore, timing control is performed such that detection of remaining ink is always performed under one predetermined condition of the aforementioned three conditions, so that remaining ink is always detected under the same condition of ink surface.

However, even if control is performed such that the detection of remaining ink is always performed under the same condition of ink surface, as the print operation continues and the amount of residual ink in the ink cartridge 9 changes, the signal waveform of current outputted from the photosensor 11 also changes.

The relation between changes in an electric current outputted from the photosensor 11 and the amount of residual ink at the time of reciprocal movement of the carriage 10 will be described below with reference to the time chart shown in FIGS. 9A–9E.

In FIGS. 9A–9E, phase a denotes an interval (the corresponding moving width will be referred to as "carriage movement width") during which the carriage 10 moves in the regular direction at a constant speed; phase b, a deceleration interval during which the carriage 10 moves at a decreasing speed until it comes to stop; phase c, an interval (hereinafter referred to as a "stop period for reversing the carriage scanning direction") during which the carriage 10 is positioned opposite to the home position and is temporarily stopped for reversing the scanning direction from the regular direction to a reversed direction; phase d, an acceleration interval from which the carriage 10 starts its motion in the reversed direction from stop until it reaches a constant speed; phase e, an interval during which the carriage 10 moves in the reversed direction at a constant speed; phase f, a deceleration interval during which the carriage 10 moves at a decreasing speed until it comes to stop; phase g, an interval (referred to as a "stop period for reversing the carriage scanning direction") during which the carriage 10 is positioned at the home position and is temporarily stopped for reversing the scanning direction from the reversed direction to the regular direction; and phase h, an acceleration interval from which the carriage 10 starts its motion from stop to move away from its home position until it reaches a constant speed.

Figures 9A, 9B, 9C, 9D, 9E:
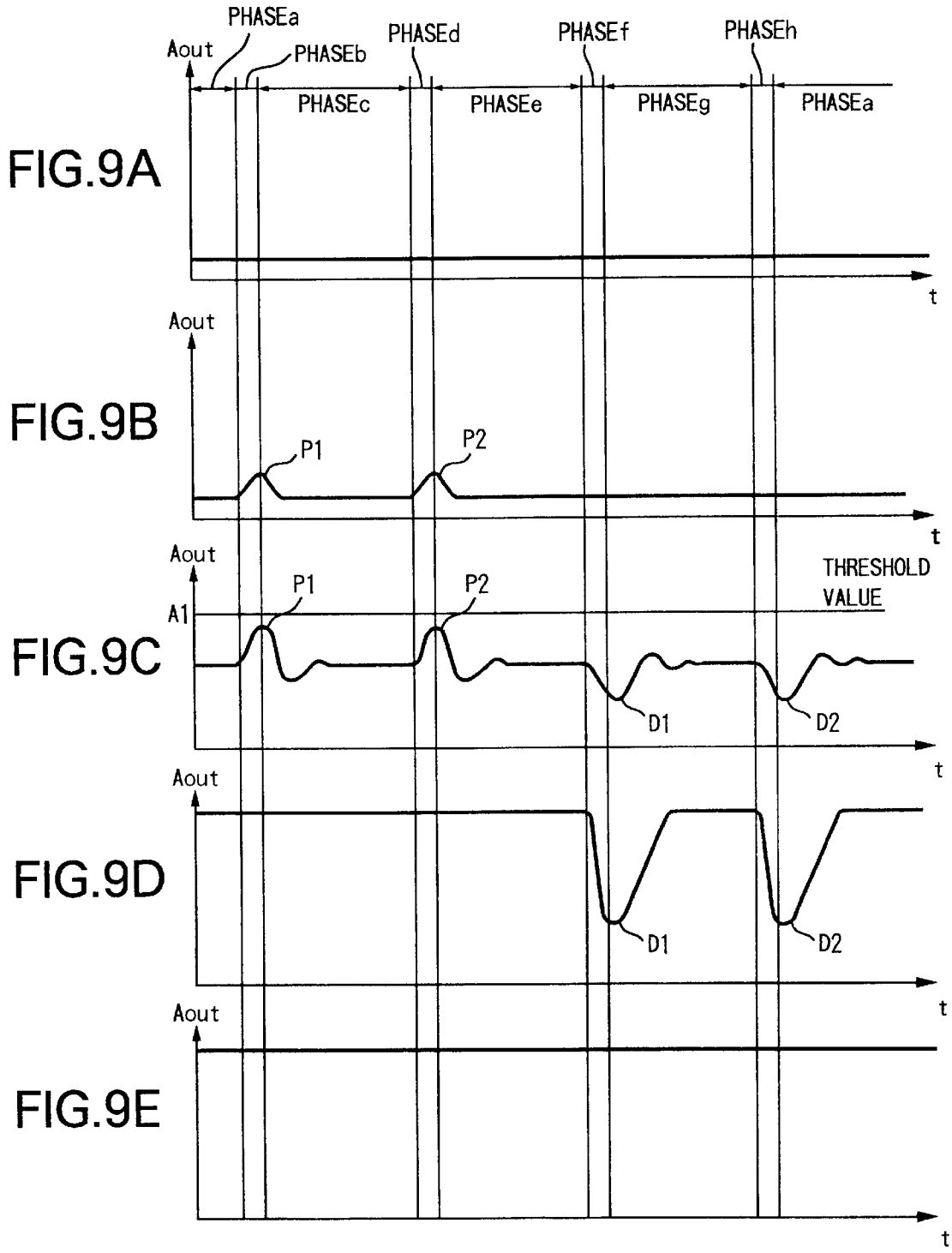
FIGS. 9A–9E are timing charts illustrating a variance of a signal wave of an output current of a photosensor 11, which accompanies the change in an amount of residual ink.

Herein, the carriage movement width (the intervals of phases a and e in FIGS. 9A–9E) of the carriage 10 and the stop period for reversing the carriage scanning direction (intervals of phases c and g in FIGS. 9A–9E) are set sufficiently large for the convenience of explanation. FIG. 9A shows the condition where the largest amount of ink remains in the ink cartridge 9; and FIGS. 9B, 9C, 9D and 9E respectively shows conditions where remaining ink gradually decreases. FIG. 9E shows the condition where the amount of remaining ink in the ink cartridge 9 is the least. In addition, in FIGS. 9A to 9E, the vertical axis indicates an output current (A out) from the photosensor 11, and the horizontal axis indicates time (t). The higher the output current (A out), the less the amount of remaining ink.

In the condition shown in FIG. 9A, although ink surface trembles because of acceleration caused by movement of the carriage 10, the trembles does not affect the photosensor 11, thus the output waveform shows no changes. Since the amount of ink starts to decrease in the condition shown in FIG. 9B, the trembles of ink surface affects the output waveform. Particularly, as can be seen from peaks (P1 and P2) of the signal waveform in FIG. 9B, the effect is seen when acceleration acts upon the ink surface during phase b and phase d. In other words, the ink surface at this stage is inclined as shown in FIG. 8; thus the amount of ink between the photosensor 11 and the reflection board 93 decreases, and the output current of the photosensor 11 increases. In this condition, the output from the photosensor 11 is still much lower compared to that in the condition where ink is exhausted as shown in FIG. 9E. This is because the embodiment employs the reflection type photosensor capable of sensing a wave-length range of light that transfers through ink up to a certain level. Also, since the sensor detects light which passes through a certain space between the photosensor 11 and the reflection board 93, the output of the sensor depends upon the amount of ink existing in the space where the light passes. Meanwhile, in the condition (phases a, c, e and g) where the acceleration does not act upon the ink, since an entire detection area is filled with ink, the output of the sensor is identical to that of FIG. 9A. When inverse acceleration acts upon the ink (phases f and g), the ink surface inclines as shown in FIG. 7; however, the output of the sensor does not change since sufficient ink exists between the photosensor 11 and the reflection board 93.

As ink is consumed and the amount of ink in the ink cartridge 9 decreases, the output level of the peaks P1 and P2 gradually increases. Output levels of flat portions other than P1 and P2 in FIG. 9B do not change for a while.

As the ink is further consumed, despite the condition where the ink surface does not experience trembles, the level of the output signal in the flat portions gradually increases as shown in FIG. 9C, as the ink surface falls within the detection area of the photosensor 11. Herein, if the inverse acceleration acts upon the ink as shown in the phases f and g, the detection area of the photosensor 11 is filled with ink as illustrated in FIG. 7; thus a level of the signal output becomes low. This change is represented by recessed portions D1 and D2 of the signal waveform in FIG. 9C. FIG. 9C shows the condition where a half of the detection area of the photosensor 11 is exposed above the ink surface.

FIG. 9C shows the condition where the ink surface is as shown in FIG. 7 or that in FIG. 8, resulting in variances (peaks P1 and P2 or recess D1 and D2) in a signal waveform. The trembles of ink surface are not immediately canceled and settled even when the carriage 10 moves at a constant speed or stops its movement. Instead, the ink surface still trembles due to the to-and-fro wave of the ink, thus the waveform of the output signal is disturbed. The disturbed waveform is attenuated as the time lapses and the waveform of the output signal returns to a flat waveform. As the ink is further consumed, the entire level of the output signal becomes high.

As the ink is further consumed and the level of the ink surface decreases, the detection area of the photosensor 11 is exposed above the ink surface even when the carriage 10 moves at a constant speed or is stopped. In this condition, ink is detected only by changes of the ink surface during the phase f and phase h as shown in FIG. 9D. Therefore, the level of the output signal becomes low only during these phases and the signal waveform becomes flat in other phases.

Further, when all the ink is completely consumed, despite the movement of the carriage 10, ink presence is no longer detected in any phases and the level of the output signal becomes high, as shown in FIG. 9E.

As can be seen from FIGS. 9A–9E, the waveform of an output signal momentarily changes from phase a to phase h, in accordance with the amount of remaining ink. Therefore, it is apparent that accurate detection of remaining ink cannot be performed without considering the change. For instance, if detection of remaining ink is performed at the timing of the phase b or phase d, determination of ink shortage would be made when the signal waveform such as that shown in FIGS. 9B or 9C is outputted. On the other hand, if detection of remaining ink is performed at the timing other than phase b or phase d, determination of ink shortage would not be made when a signal waveform such as that shown in FIGS. 9B or 9C is outputted.

In addition, the operation of the carriage 10 does not always generate one pattern of change in the output signal waveform as described above. In practice, the waveform of the output signal varies in a case where (A) speed of carriage movement varies; (B) scanning width of the carriage varies; and (C) a stop period for reversing the carriage scanning direction varies. Hereinafter, descriptions will be provided on the signal waveform in the respective cases of (A) to (C).

(A) The Case Where Speed of Carriage Movement Varies

In the case of printing by the ink-jet printing method, there is a characteristic in that print quality is determined by the time required for printing a single dot. Therefore, an apparatus comprising a printing apparatus or a printing unit adopting the ink-jet printing method normally includes two printing modes: a print-quality-oriented mode and a print-speed-oriented mode. More specifically, when the print-quality-oriented mode is selected, the speed of carriage movement is reduced to perform printing. Meanwhile when the print-speed-oriented mode is selected, the speed of carriage movement is increased, sacrificing the printing quality.

As the speed of the carriage 10 is increased/decreased, the degree of acceleration/deceleration added to the carriage at the time of increasing/decreasing the speed naturally varies, thus the variance largely affects trembling condition of the ink surface. For instance, assume that the level of ink surface is low and the detection area of the photosensor 11 is partially exposed above the ink surface, as described with reference to FIG. 9C.

Figures 10A, 10B:
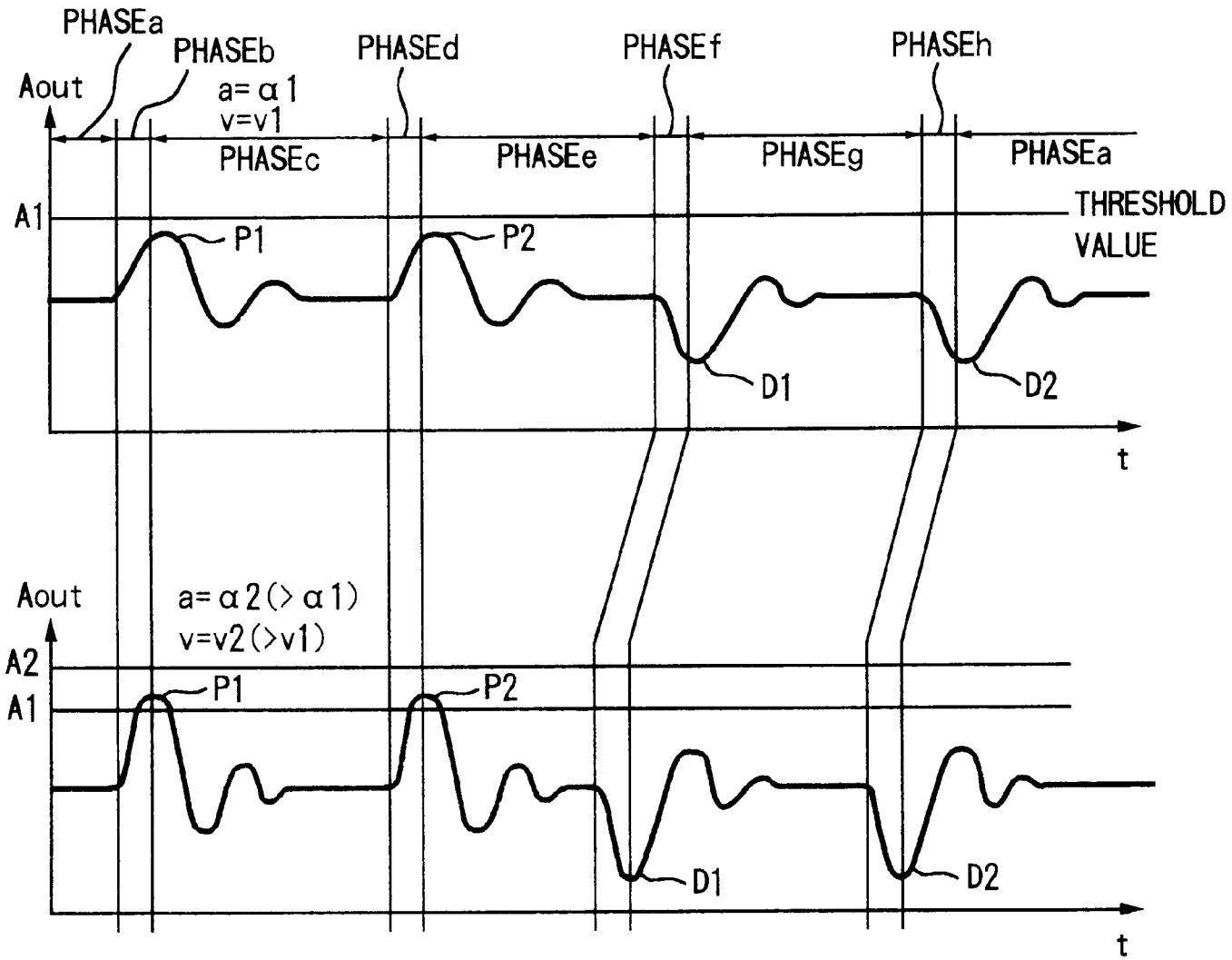
FIGS. 10A and 10B are timing charts illustrating a variance of a signal wave of an output current of the photosensor 11, which accompanies the change in scanning speed of a carriage.

FIG. 10A shows a signal waveform of an output current of the photosensor 11 obtained when the carriage accelerates/decelerates with an acceleration (a) being $a=\alpha 1$, or when the carriage 10 moves at a constant speed of a moving velocity (v) being $v=v1$, in the condition where the detection area of the photosensor 11 is partially exposed above the ink surface, that is, the condition described above with reference to FIG. 9C. Meanwhile, FIG. 10B shows a signal waveform of an output current of the photosensor 11 obtained when the carriage 10 accelerates/decelerates with the acceleration (a) being $a=\alpha 2$ ($>\alpha 1$), and when the carriage 10 moves at a constant speed of the moving velocity (v) being $v=v2$ ($>v1$) in a case where an amount of remaining ink is the same as that in FIG. 10A. Herein, it is assumed that the duration of the acceleration/deceleration, scanning width of the carriage, and a stop period for reversing the carriage scanning direction are the same in each of the cases.

Since the velocity of the carriage movement is higher in FIG. 10B than that of FIG. 10A, the phase e is shorter in FIG. 10B as compared to that in FIG. 10A. As apparent from comparison of the signal waveforms shown in FIGS. 10A and 10B, even if detection of remaining ink is performed at the same timing of the carriage movement (e.g. phase b or phase d) and the amount of remaining ink is the same in each of the cases, the difference in the velocity of carriage movement affects the signal waveform of the output current of the photosensor 11, thus affecting precision of the detection of remaining ink.

Moreover, such variance in velocity of carriage movement not only depends upon the above printing mode, but also depends upon the moving direction (forward/backward) of the carriage. An example is given by an apparatus having a construction such that print operation is performed by moving the carriage only in the forward direction, and in the backward direction, the carriage does not perform print operation but is simply returned to a home position at the highest speed.

(B) The Case Where Scanning Width of the Carriage Varies

The scanning width of the reciprocal movement of carriage 10 is not always the same because of, e.g. the following reasons:

(1) The scanning width varies depending on whether the size of the print sheet set in the apparatus is A4, B4 or other sizes;

(2) Even if the size of a print sheet is fixed, depending on print data, the area to be printed is sometimes localized near the home position (in an extreme case, one scanning of the carriage prints only one dot), or localized to a particular area of the print sheet. When printing is performed using such data, the reciprocal movement of the carriage is limited to a particular range.

In the above described case, acceleration and deceleration of carriage movement is executed in an extremely short interval. Therefore, before the ink surface which has trembled at the time of carriage acceleration becomes stable, another tremble is generated on the ink surface caused by deceleration of the carriage. As a result, trembles caused by both the acceleration and deceleration of the carriage are generated on the ink surface.

Figures 11A, 11B, 11C:
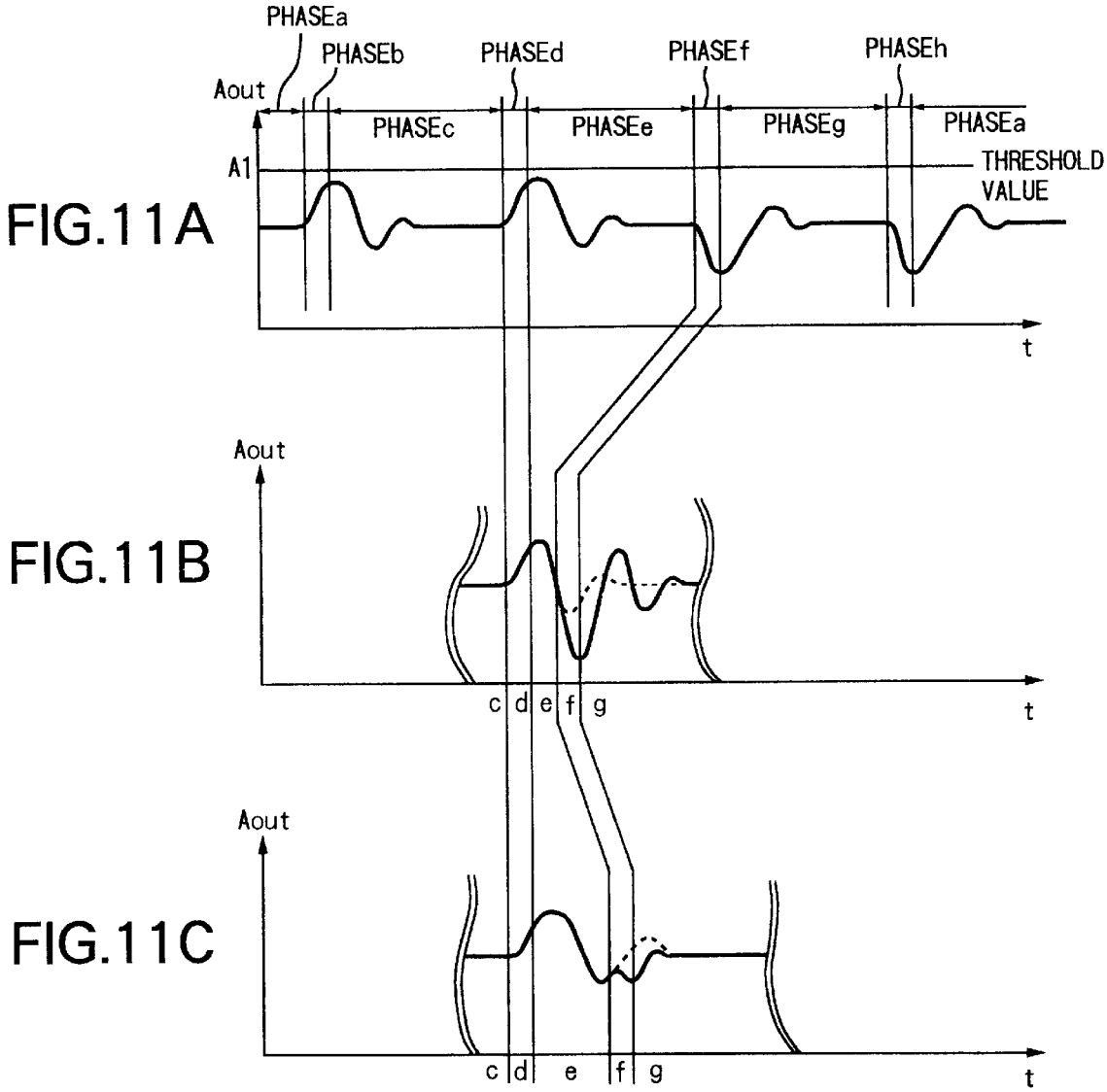
FIGS. 11A–11C are charts illustrating a variance of a signal wave of an output current of the photosensor 11, which accompanies the change in scanning width of a carriage.

FIG. 11A shows a signal waveform of an output current of the photosensor 11 obtained when the carriage accelerates/decelerates with an acceleration (a) being $a=\alpha 1$, or when the carriage 10 moves at a constant speed of a moving velocity (v) being $v=v1$, in the condition where the detection area of the photosensor 11 is partially exposed above the ink surface, that is, the condition described above with reference to FIGS. 9C and 10A. Herein, it is assumed that the scanning width (w) in the phase e is $w=w1$. FIG. 11B shows the signal waveform of the output current of the photosensor 11 obtained under the same condition of FIG. 11A other than a condition where the scanning width (w) in the phase e is $w=w2<w1$. Similarly, FIG. 11C shows the signal waveform of the output current of the photosensor 11 obtained under the same condition of FIG. 11A other than a condition where the scanning width (w) in the phase e is $w=w3<w2<w1$, being different from the case in FIG. 11A or FIG. 11B.

The signal waveform shown in FIG. 11B corresponds to the condition where deceleration in the phase f begins while an output current is being decreased due to trembles of the ink surface generated by the acceleration in the phase d (i.e. the ink surface is rapidly being changed from the condition shown in FIG. 8 to the condition in FIG. 7). Meanwhile, the signal waveform shown in FIG. 11C corresponds to the condition where deceleration in the phase f begins while an output current is being increased due to trembles of the ink surface generated by the acceleration in the phase d (i.e. the ink surface is rapidly being changed from the condition shown in FIG. 7 to the condition shown in FIG. 8).

The following is understood from FIGS. 11B and 11C. In the condition of FIG. 11B, since the tremble phase of the ink surface newly generated by the acceleration in phase f coincides with the tremble phase of the ink surface generated by the acceleration in phase d, the trembles on the ink surface is amplified. Therefore, the output current of the photosensor 11 does not correctly reflect the amount of actual remaining ink. On the contrary, in the condition of FIG. 11C, the trembles of the ink surface generated in the two phases (phase d and phase f) show inverse phases, canceling the amplitude of the trembles. Accordingly, an output current of the photosensor 11 which is not largely affected by the trembles of the ink surface is obtained. Herein, typical two examples are described; however, it is apparent that various combination would occur depending on the timing at which the deceleration (phase f) begins. The similar phenomenon occurs when inverse acceleration acts upon the ink surface, i.e. in the phase a.

Taking the above-described variance of output current of the photosensor 11 into consideration, if it is assumed that detection of remaining ink is performed when the carriage 10 is decelerating, e.g. at the timing of phase f, the detection result of the remaining ink largely varies depending on the scanning width of the carriage as shown in FIGS. 11B or 11C. Moreover, since the scanning width of a carriage depends upon print data as described above, the scanning width may change for each scanning, thus the detection result of remaining ink varies.

(C) The Case Where Stop Period for Reversing the Carriage Scanning Direction Varies Carriage 10 starts its motion for print operation when print data corresponding to one scanning is stored in a line buffer defined in the RAM 103. In other words, the movement of the carriage 10 is stopped until the data is ready. This is due to the fact that, in the case of a printer, time is required for transmitting data from a host computer, or for bitmapping font data to bitmap data on the basis of character data, or for converting data in an appropriate form for multiscan-print control. In the case of a facsimile apparatus, additional time is required for transmitting data via a communication line. These time depends upon the amount of data or transmission capability of the line, thus is not always the same. Therefore, the stop period for reversing the carriage scanning direction is also not fixed because of the aforementioned factors.

Figure 12A:
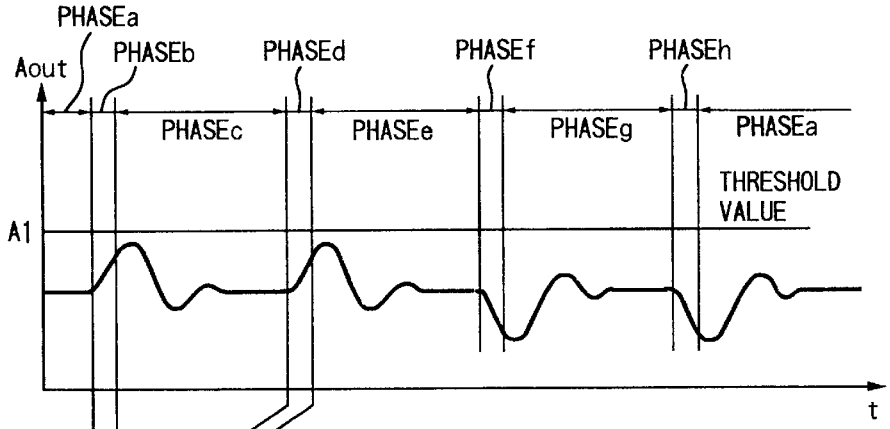
FIGS. 12A–12C are charts illustrating a variance of a signal wave of an output current of the photosensor 11, which accompanies the change in a scanning-stop period for reversing the moving direction of the carriage.
Figure 12B:
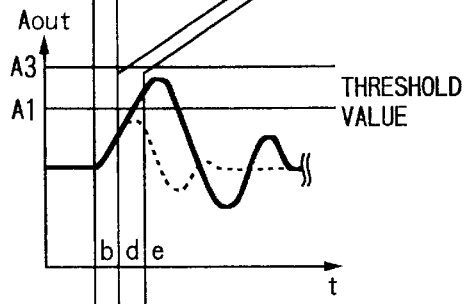

FIG. 12A shows a signal waveform of an output current of the photosensor 11 obtained when the carriage accelerates/decelerates with an acceleration (a) being $a=\alpha 1$, or when the carriage 10 moves at a constant speed of a moving velocity (v) being $v=v1$, in the condition where the detection area of the photosensor 11 is partially exposed above the ink surface, that is, the condition described above with reference to FIGS. 9C, 10A and 11A. Herein, it is assumed that the carriage stop period (p) in the phase c is $p=p1$. FIG. 12B shows a signal waveform of the output current of the photosensor 11 obtained under the same condition of FIG. 12A other than a condition where the carriage stop period (p) in the phase c is $p=p2$ $(=0)$ $<p1$. Similarly, FIG. 12C shows the signal waveform of the output current of the photosensor 11 obtained under the same condition of FIG. 12A other than a condition where the carriage stop period (p) in the phase c is $p=p3$ $(p2<p3<p1)$, being different from the case in FIG. 12A or FIG. 12B.

Figure 12C:
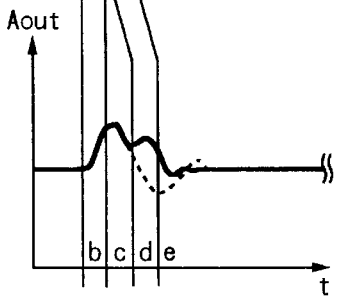

As apparent from the comparison among the signal waveforms shown in FIGS. 12A, 12B and 12C, as similar to the case due to the variance in carriage scanning width, trembles of the ink surface are combined because of the variance in the carriage stop period (p), generating various signal waveforms. For instance, while the stop period is sufficiently long as shown in FIG. 12A, in FIG. 12B there is no stop period, causing to generate positive acceleration immediately after negative acceleration. Therefore, the duration of the acceleration acting upon the ink is doubled in FIG. 12B as compared to that in FIG. 12A. In a case where the stop period is short as shown in FIG. 12C, acceleration due to carriage movement acts upon the ink before trembles of the ink surface caused by deceleration of the carriage is settled. Depending on the timing, the trembles of ink is amplified or attenuated. Therefore, a detection result of remaining ink largely varies depending on the carriage stop period. Furthermore, since the carriage stop period depends upon print data as has been described above, the stop period may change for each scanning, thus the detection result of remaining ink varies.

In addition, factors such as the base area of an ink tank, viscosity of ink, a cycle of ink-surface trembles, amplification or attenuation of trembles of ink surface or the like, also cause variances in the detection result of remaining ink. However, since those factors, other than the cycle of ink-surface trembles and the amplitude of trembles, are static, such influence can be considered in advance into controlling the detection of remaining ink.

Hereinafter, the above description is summarized. As print operation proceeds and ink is consumed until the reflection board 93 in the ink cartridge 9 is partially exposed above the ink surface, the signal waveform of the output current of the photosensor 11 varies depending on changes in velocity of carriage movement, scanning width of the carriage, and a stop period for reversing the carriage scanning direction, thus largely affecting a result of detecting remaining ink.

Meanwhile, the velocity of carriage movement, scanning width of the carriage and a stop period for reversing the carriage scanning direction are controlled by the CPU 101; therefor the CPU 101 always knows these values.

In view of the above description, according to the present embodiment, the CPU 101 always monitors the value of the output current (A out) from the photosensor 11, being converted by the A/D converter 153. When the value exceeds a predetermined level, it is determined that the amount of remaining ink is reduced to such level that the reflection board 93 in the ink cartridge 9 is exposed above the ink surface. A threshold value utilized in the subsequent determination, that is, remaining ink detection processing performed after further-discharging control, is dynamically changed in accordance with the print control to be performed.

For instance, if detection of remaining ink is to be performed at the timing of phase d, a regular threshold value is set as A out=A1, as shown in FIGS. 9C, 10A, 11A and 12A.

However, in a case where the velocity (v) of carriage movement is high as shown in FIG. 10B, the CPU 101 performs controlling to change the threshold value to A2 (>A1). Similarly, in a case where there is no carriage stop period (p) as shown in FIG. 12B, the CPU 101 performs controlling to change the threshold value to A3 (>A1).

As described above, according to the present embodiment, in a case where print operation is performed with further-discharging control, the threshold value is dynamically changed in accordance with print control to be performed. Accordingly, it is possible to perform detection of remaining ink taking into consideration the signal waveform of the output current of the photosensor 11 which is apt to change according to a printing condition, without being affected by the printing condition.

In the foregoing descriptions, explanations have been provided in a case where detection of remaining ink is performed at a predetermined single timing of reciprocal movement of a carriage; however, the present invention is not limited to this. For instance, the amount of remaining ink may be detected at plural numbers of timing, and a mean value of the detection results is obtained and is compare with the threshold value. Alternatively, an integration of the detection results may be obtained over a predetermined period of time to compare the integration result with the threshold value. Alternatively, the detection of remaining ink may be performed for a plurality of times with a predetermined interval and the respective results may be compared with the threshold value to obtain a final result employing a majority principle.

In any cases, the result obtained in the foregoing manner is utilized for determining residual ink detection in step S1.

Moreover, in the foregoing descriptions, an explanation has been provided with a facsimile apparatus as an example; however, the present invention is not limited to this. For instance, the present invention is applicable to a printer adopting an ink-jet printing method, or a copy machine utilizing the printer or the like.

Furthermore, the apparatus may be constructed such that the detection result of remaining ink obtained in the above described processing is displayed in an LCD of the display unit 113. In addition, the number of printed pages and the number of printed dots or the like may be counted during the period of the remaining ink detection. Upon further-discharging control, time remaining before the ink is completely consumed may be predicted based on these information, and the result may be displayed in the LCD.

[Other Embodiments]

In the above described embodiment, an example is provided for a case where a threshold value, used for detecting remaining ink, is dynamically changed in accordance with print control to be performed. Hereinafter, descriptions will be provided for a case where a time period for performing further-discharging control is dynamically changed after determination of ink shortage is made, in accordance with changes in printing conditions such as speed of carriage movement, scanning width of the carriage, and a stop period for reversing the carriage scanning direction or the like.

Assume that a threshold value used for detecting the amount of remaining ink is fixed to A1 and the processing of detecting remaining ink is to be performed at the timing of phase d. If the speed of carriage movement is high as shown in FIG. 10B, determination of ink shortage is sometimes made despite sufficient ink remaining in the ink cartridge. Alternatively, assume that the processing of detecting remaining ink is to be performed at the timing of phase f. If the speed of carriage movement is high as shown in FIG. 10B, determination of ink shortage would not be made until the amount of remaining ink in the ink cartridge becomes small.

As explained above, depending on the timing, or depending on a printing condition at which the detection of remaining ink is performed, the determination of ink shortage does not always represent an actual amount of remaining ink.

Accordingly, in the present embodiment, the CPU 101 is controlled such that a threshold value (n), utilized for determining an end of further-discharging control in step S6 in the flowchart shown in FIG. 6, is changed in accordance with a printing condition or timing at which the determination of ink shortage is made. For instance, assume that the normal threshold value (n) is n=n1. When determination of ink shortage is made at the timing of phase d during the print operation with high-speed carriage movement as shown in FIG. 10B, the CPU 101 performs controlling to change the threshold value (n) to n=n2 (>n1). By virtue of this control, a larger amount of prints can be printed in the print operation with the further-discharging control which efficiently utilizes remaining ink.

Meanwhile, When determination of ink shortage is made at the timing of phase f during the print operation with high-speed carriage movement as shown in FIG. 10B, the CPU 101 performs controlling to change the threshold value (n) to n=n3 (<n1). By this control, print operation can be suspended before ink is completely consumed, that is, before print operation becomes impossible.

Therefore, according to the present embodiment, it is possible to more precisely perform further-discharging control in accordance with an actual amount of remaining ink.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision print operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

In addition, an exchangeable chip type printhead which can be electrically connected to the apparatus main unit and can receive an ink from the apparatus main unit upon being mounted on the apparatus main unit or a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the print operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a print medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like.

The present invention can be applied to a system constituted by a plurality of devices, or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing print on a print medium by scanning a printhead and an ink tank containing ink and by discharging ink from the printhead, said printing apparatus comprising:

scan means for reciprocally moving the printhead and the ink tank together;

detection means for detecting whether or not a liquid surface of ink is at a in the ink tank predetermined level; and control means for determining a decreased state of the liquid surface of ink, said determination being based at least in part on a comparison of a detection result by said detection means against a reference, and for changing the reference for said determination in accordance with conditions of reciprocal movement of the ink tank by said scan means.

2. The apparatus according to claim 1, wherein the conditions of the reciprocal movement of the printhead and the ink tank by said scan means include at least any one of moving speed of the printhead and the ink tank, moving width of the printhead and the ink tank, and a stop period for reversing a moving direction of the printhead and the ink tank.

3. The apparatus according to claim 1, wherein said detection means includes:

a reflection-type photosensor comprising a light-emitting device and a photoreceptor; and a reflection board for reflecting light from the light-emitting device, wherein said reflection-type photosensor and said reflection board are set such that a light-emission direction of the light-emitting device and a reflection direction of reflected light by the reflection board are parallel to a reciprocal movement direction of the printhead and the ink tank by said scan means, and that a reflection surface of the reflection board is opposite to the light-emission direction, and wherein said reflection-type photosensor is in contact with an exterior side wall of the ink tank, and the reflection board is provided inside the ink tank.

4. The apparatus according to claim 3, wherein said control means further includes comparison means for comparing an output of said reflecting-type photosensor with the reference.

5. The apparatus according to claim 1, wherein said detection means detects the amount of residual ink at a fixed timing of the reciprocal movement of the printhead and the ink tank moved by said scan means.

6. The apparatus according to claim 1, wherein the reference is changed by said control means when determination of ink shortage is made for a second time during further print operation which is continued after an amount of ink in the ink tank is reduced and determination of ink shortage is made a first time.

7. The apparatus according to claim 1, wherein said printhead discharges ink by utilizing thermal energy, and includes a thermal energy transducer for generating thermal energy to be provided to ink.

8. The apparatus according to claim 1, further comprising display means for displaying a detection result obtained by said detection means.

9. A printing apparatus for performing a print operation on a print medium by scanning a printhead and an ink tank containing ink and by discharging ink from the printhead, said printing apparatus comprising:

scan means for reciprocally moving the printhead and an ink tank together;

detection means for detecting an amount of residual ink in the ink tank; and print control means for controlling such that the print operation is further continued even after said detection means detects shortage of the residual ink, wherein said print control means controls a duration period of the print operation further performed after said detection means detects shortage of the residual ink, in accordance with conditions of reciprocal movement of the printhead and the ink tank by said scan means.

10. The apparatus according to claim 9, wherein the conditions of the reciprocal movement of the printhead and the ink tank by said scan means include at least any one of moving speed of the printhead and the ink tank, moving width of the printhead and the ink tank, and a stop period for reversing a moving direction of the printhead and the ink tank.

11. The apparatus according to claim 9, wherein said detection means includes:

a reflection-type photosensor comprising a light-emitting device and a photoreceptor; and a reflection board for reflecting light from the light-emitting device, wherein said reflection-type photosensor and said reflection board are set such that a light-emission direction of the light-emitting device and a reflection direction of reflected light by the reflection board are parallel to a reciprocal movement direction of the printhead and the ink tank by said scan means, and that a reflection surface of the reflection board is opposite to the light-emission direction, and wherein said reflection-type photosensor is in contact with an exterior side wall of the ink tank, and the reflection board is provided inside the ink tank.

12. The apparatus according to claim 9, wherein said print control means includes:

a counter for counting an amount of ink discharged in the print operation further performed after said detection means detects shortage of the residual ink; and comparison means for comparing the amount of discharged ink counted by said counter with a predetermined threshold value.

13. The apparatus according to claim 12, wherein said print control means changes the predetermined threshold value in accordance with the conditions of reciprocal movement of the printhead and the ink tank by said scan means.

14. The apparatus according to claim 9, wherein said printhead discharges ink by utilizing thermal energy, and includes a thermal energy transducer for generating thermal energy to be provided to ink.

15. The apparatus according to claim 9, wherein said detection means detects the amount of residual ink at a fixed timing of the reciprocal movement of the printhead and the ink tank moved by said scan means.

16. A facsimile apparatus comprising:

facsimile means for facsimile communicating with a remote facsimile apparatus, said facsimile means obtaining image data for local printout; and a printing apparatus for printing the image data on a print medium by scanning a printhead and an ink tank containing ink and by discharging ink from the printhead, said printing apparatus including scan means for reciprocally moving the printhead and the ink tank together, detection means for detecting whether or not a liquid surface of ink is at a in the ink tank predetermined level, and control means for determining a decreased state of the liquid surface of ink, said determination being based at least in part on a comparison of a detection result by said detection means against a reference, and for changing the reference for said determination in accordance with conditions of reciprocal movement of the ink tank by said scan means.

17. A facsimile apparatus comprising:

facsimile means for facsimile communicating with a remote facsimile apparatus, said facsimile means obtaining image data for local printout; and printing apparatus for performing a print operation on a print medium by scanning a printhead and an ink tank containing ink and by discharging ink from the printhead, said printing apparatus including scan means for reciprocally moving the printhead and an ink tank together, detection means for detecting an amount of residual ink in the ink tank, and print control means for controlling such that the print operation is further continued even after said detection means detects shortage of the residual ink, wherein said print control means controls a duration period of the print operation further performed after said detection means detects shortage of the residual ink, in accordance with conditions of reciprocal movement of the printhead and the ink tank by said scan means.

18. A control method of controlling ink residual detection in an ink-jet printer in which a printhead reciprocally moves together with an ink tank containing ink, and discharges ink from the ink tank onto a print medium, comprising the steps of:

detecting whether or not a liquid surface of ink is at a predetermined level in the ink tank;

monitoring conditions of reciprocal movement of the printhead and the ink tank; and determining a decreased state of the liquid surface of ink, said determining step being based at least in part on a comparison of a detection result in said detecting step against a reference; and changing the reference for said determining step in accordance with a monitoring result obtained in said monitoring step.

19. A print control method of controlling print operation in which a printhead reciprocally moves together with an ink tank containing ink, and discharges ink from the ink tank onto a print medium, comprising the steps of:

detecting an amount of residual ink in the ink tank;

monitoring conditions of reciprocal movement of the printhead; and controlling such that the print operation is further continued even after shortage of the residual ink is detected in said detecting step, wherein in said control step, a duration period of the print operation, further performed after shortage of the residual ink is detected, is controlled in accordance with a monitoring result obtained in said monitoring step.

* * * * *

UNITED STATES PATENT AND TRADEMARK OFFICE

CERTIFICATE OF CORRECTION

PATENT NO. : 6,012,794

DATED : January 11, 2000

INVENTOR(S) : Yuji Nakano, et al.

It is certified that error appears in the above-identified patent and that said Letters Patent is hereby corrected as shown below:

Column 1

Line 43, change "print" to --printing--.

Column 2

Line 24, change "ink." to --the ink.--; and
line 29, change "print" to --printing--.

Column 3

Line 14, change "ink." to --the ink.--.

Column 5

Line 13, change "10:6" to --10--;
line 33, change "of" to --of a--;
line 35, change "comprising" to --comprised--; and
line 49, change "Numeral" to --Numeral 25--.

UNITED STATES PATENT AND TRADEMARK OFFICE

CERTIFICATE OF CORRECTION

PATENT NO. : 6,012,794

DATED : January 11, 2000

INVENTOR(S) : Yuji Nakano, et al.

It is certified that error appears in the above-identified patent and that said Letters Patent is hereby corrected as shown below:

Column 6

Line 64, delete "it"; and
line 66, change "not" to --if not--.

Column 9

Line 6, delete "ic:".

Column 11

Line 16, change "sheet." to --sheets.--; and
line 18, change "printed" to --the printed--.

Column 13

Line 30, change "to" to --to a--;
line 41, change "to" to --to a--; and
line 57, change "show" to --shows--.

Column 15

Line 44, change "carriage" to --carriage 10--.

UNITED STATES PATENT AND TRADEMARK OFFICE

CERTIFICATE OF CORRECTION

PATENT NO. : 6,012,794

DATED : January 11, 2000

INVENTOR(S) : Yuji Nakano, et al.

It is certified that error appears in the above-identified patent and that said Letters Patent is hereby corrected as shown below:

Column 17

Line 3, change "is" to --are--;
line 11, change "typical two" to --two typical--;
line 12, change "combination" to --combinations--; and
line 38, change "These" to --This--.

Column 18

Line 8, change "is" to --are--; and
line 34, change "therefor" to --therefore--.

Column 19

Line 5, change "compare" to --compared--; and
line 29, change "these" to --this--.

Column 20

Line 5, change "When" to --when--.

UNITED STATES PATENT AND TRADEMARK OFFICE

CERTIFICATE OF CORRECTION

PATENT NO. : 6,012,794

DATED : January 11, 2000

INVENTOR(S) : Yuji Nakano, et al.

It is certified that error appears in the above-identified patent and that said Letters Patent is hereby corrected as shown below:

Column 22

Line 2, delete "in the ink tank"; and
line 3, after "level" insert --in the ink tank--.

Column 23

Line 62, delete "in the ink tank".

Column 24

Line 1, after "level" insert --in the ink tank--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*